US009127418B2

(12) United States Patent
Bockes et al.

(10) Patent No.: US 9,127,418 B2
(45) Date of Patent: Sep. 8, 2015

(54) INDEPENDENTLY SUPPORTED CONCRETE SAW APPARATUS AND METHOD

(71) Applicants: Roger Bockes, Grundy Center, IA (US); Robert Bockes, Eldora, IA (US)

(72) Inventors: Roger Bockes, Grundy Center, IA (US); Robert Bockes, Eldora, IA (US)

( * ) Notice: Subject to any disclaimer, the term of this patent is extended or adjusted under 35 U.S.C. 154(b) by 0 days.

(21) Appl. No.: 14/158,894

(22) Filed: Jan. 20, 2014

(65) Prior Publication Data

US 2015/0050085 A1 Feb. 19, 2015

Related U.S. Application Data

(63) Continuation-in-part of application No. 14/029,478, filed on Sep. 17, 2013, which is a continuation-in-part of application No. 13/970,364, filed on Aug. 19, 2013, now abandoned.

(51) Int. Cl.
*B28D 1/04* (2006.01)
*E01C 23/09* (2006.01)
*E01C 19/00* (2006.01)

(52) U.S. Cl.
CPC ..... *E01C 23/0966* (2013.01); *E01C 23/0933* (2013.01); *E01C 19/004* (2013.01)

(58) Field of Classification Search
CPC ..... B28D 1/045; B28D 5/0082; B28D 5/045; E01C 23/166; E01C 23/18; E01C 23/22
USPC ..... 125/12, 13.03, 13.01; 451/69, 70, 461; 404/72, 75, 89, 93, 94, 105, 87; 299/39.3; 249/2
See application file for complete search history.

(56) References Cited

U.S. PATENT DOCUMENTS

| | | | | | |
|---|---|---|---|---|---|
| 1,392,161 | A | * | 9/1921 | Hilts | 404/89 |
| 1,980,523 | A | * | 11/1934 | Heltzel | 404/89 |
| 2,546,308 | A | * | 3/1951 | Kahler | 156/575 |
| 2,935,981 | A | * | 5/1960 | Middlestadt | 299/39.3 |
| 3,257,917 | A | * | 6/1966 | Lewis | 404/105 |
| 3,266,846 | A | * | 8/1966 | Luksch et al. | 299/39.9 |
| 3,291,532 | A | * | 12/1966 | Hatcher | 299/39.3 |
| 3,381,595 | A | * | 5/1968 | Hanson | 404/89 |
| 3,409,330 | A | * | 11/1968 | Hatcher et al. | 299/39.4 |
| 3,416,415 | A | * | 12/1968 | Worson | 404/74 |
| 3,779,609 | A | * | 12/1973 | James | 299/39.3 |
| 3,796,462 | A | * | 3/1974 | Staab | 299/1.5 |
| 3,874,806 | A | * | 4/1975 | Grist et al. | 404/93 |
| 3,887,294 | A | * | 6/1975 | Leon | 404/89 |
| 3,901,553 | A | * | 8/1975 | Binger et al. | 299/39.3 |

(Continued)

FOREIGN PATENT DOCUMENTS

WO WO-2012135048 A2 10/2012

*Primary Examiner* — George Nguyen
(74) *Attorney, Agent, or Firm* — Mitchell Law PLLC; Matthew W. Mitchell

(57) ABSTRACT

A saw apparatus is disclosed for sawing paving slabs. The saw apparatus has a frame mounted on a ground contacting propulsion member such that the frame straddles above a slab to be cut without touching the slab. A first saw support assembly disposes one or more blades of a saw in cutting engagement with the slab for a transverse cut. A second saw support assembly disposes a blade of another saw in cutting engagement with the slab for a longitudinal cut. The saw assemblies are configured to selectively, in a single pass along and over a slab, cut, vacuum, clean via pressurized air, fill a cut slot, and apply sealant to a cut slot concurrently with respect to a slot and sequentially with respect to a point of a slot.

20 Claims, 20 Drawing Sheets

(56) References Cited

U.S. PATENT DOCUMENTS

| | | | | | |
|---|---|---|---|---|---|
| 4,186,968 | A * | 2/1980 | Barton | 299/39.2 |
| 4,197,032 | A * | 4/1980 | Miller | 404/98 |
| 4,676,557 | A * | 6/1987 | Shope et al. | 299/39.3 |
| 4,762,371 | A * | 8/1988 | Lupton | 299/39.8 |
| 5,042,207 | A * | 8/1991 | Kirn | 451/342 |
| 5,135,287 | A * | 8/1992 | Karnes | 299/39.3 |
| 5,168,683 | A * | 12/1992 | Sansom et al. | 52/396.04 |
| 5,215,071 | A * | 6/1993 | Mertes et al. | 125/13.01 |
| 5,259,145 | A * | 11/1993 | Fushiya et al. | 451/342 |
| 5,464,365 | A * | 11/1995 | Kirn | 451/344 |
| 5,468,094 | A * | 11/1995 | Vanderpan et al. | 404/75 |
| 5,582,899 | A * | 12/1996 | Chiuminatta et al. | 428/167 |
| 5,746,539 | A * | 5/1998 | Mara | 404/84.05 |
| 5,921,228 | A * | 7/1999 | Watson | 125/13.01 |
| 6,102,022 | A * | 8/2000 | Schave | 125/13.01 |
| 6,171,017 | B1 * | 1/2001 | Watkins | 404/84.05 |
| 6,464,020 | B1 * | 10/2002 | Wills | 175/20 |
| 6,809,294 | B2 * | 10/2004 | Velinsky et al. | 219/213 |
| 6,872,028 | B2 * | 3/2005 | Aeschlimann et al. | 404/105 |
| 7,128,641 | B1 * | 10/2006 | Lin | 451/359 |
| 7,387,464 | B2 * | 6/2008 | Hall et al. | 404/94 |
| 7,387,465 | B2 * | 6/2008 | Hall et al. | 404/94 |
| 7,438,634 | B2 * | 10/2008 | Habele | 451/359 |
| 7,942,605 | B2 * | 5/2011 | Hall et al. | 404/94 |
| 7,972,199 | B2 * | 7/2011 | Blatz et al. | 451/359 |
| 8,365,715 | B2 * | 2/2013 | Toncelli | 125/35 |
| 2002/0017817 | A1 * | 2/2002 | Nakayama | 299/39.3 |
| 2002/0065746 | A1 | 5/2002 | Lewis | |
| 2002/0078941 | A1 * | 6/2002 | Pozzi et al. | 125/16.01 |
| 2003/0072612 | A1 * | 4/2003 | Colvard et al. | 404/105 |
| 2006/0157045 | A1 * | 7/2006 | Galambos et al. | 125/13.01 |
| 2007/0244585 | A1 | 10/2007 | Speiser | |
| 2008/0300055 | A1 | 12/2008 | Lutnick | |
| 2010/0266339 | A1 * | 10/2010 | Guntert et al. | 404/105 |
| 2011/0194898 | A1 * | 8/2011 | Guntert et al. | 404/105 |
| 2011/0203565 | A1 * | 8/2011 | Hilsgen et al. | 125/13.03 |
| 2012/0122529 | A1 | 5/2012 | Lyons | |

* cited by examiner

INDEPENDENTLY SUPPORTED CONCRETE SAW APPARATUS AND METHOD

CROSS-REFERENCE TO RELATED APPLICATIONS

This application claims priority to and is a continuation-in-part application of U.S. application Ser. No. 14/029,478 filed Sep. 17, 2013 which in turn claims priority to and is a continuation-in-part application of Ser. No. 13/970,364, filed Aug. 19, 2013 each of which is incorporated by reference herein in its entirety.

TECHNICAL FIELD

The field of the present invention is in paving equipment.

BACKGROUND

The statements in this section merely provide background information related to the present disclosure and may not constitute prior art.

Poured concrete roadways are known to expand and contract in response to seasonal temperature variations. This expansion and contraction will cause uncontrolled cracking in random patterns that will disrupt the surface, provide a rough ride for vehicles traveling over the road and shorten the lifespan of the roadway. The traditional response has been to deliberately cut controlled expansion joints as slots in the roadway slab in order to provide room for expansion in a controlled fashion. These expansion joints in concrete roadways are cut in straight lines, have short metal dowel bars embedded in the concrete underneath them for strength and are typically sealed by a compressible yet waterproof material to keep ice from forming in the cracks. Usually the expansion joints are cut perpendicular to the direction of travel on the roadway, although angled variants are known.

During construction, there are frequent circumstances, for example, hot, windy conditions, when the contractor pouring a new roadway slab faces the possibility of the concrete drying quickly enough that uncontrolled cracking in random patterns on the surface of the slab may begin quickly, sometimes within the space of a few hours. A new slab for a roadway or a runway at an airport having uncontrolled cracking will not meet the specifications of the Department of Transportation or other authority responsible for the new paving. Accordingly, if such uncontrolled cracking appears in newly poured slab, contractor will be required to tear out the slab and start over.

Controlled expansion joint slots are cut into newly poured paving slabs by concrete saws. Concrete saws are comprised of a rotary disk having a cutting edge, a power supply such as an engine to turn the blade and a height adjustment apparatus. Prior art concrete saws, particularly those powerful enough for the paving industry, were heavy, sometimes up to a ton in weight. This weight was supported by wheels, typically four. The wheels on the prior art machines were small metal wheels in order to support the weight of the saw. The small size of the wheels consequently delivered a heavy loading factor to the surface of the slab being cut due to the small area of the wheels touching the slab surface. Accordingly, prior art saws could only work on slabs that were already dry. If the slab was not thoroughly dry, the weight of the concrete saw would cause the saw wheels to sink into the insufficiently dry slab surface, thereby creating unacceptable indentations in it. Hence prior art saws could not be used to cut expansion slots in slabs that were drying too quickly to avoid rapid cracking, because such slabs were still too wet to support the saw's weight.

It is also required that the concrete saws cut the expansion joints in the proper location, and to be as straight as possible. This is done in the prior art by chalk lines. The chalk line was followed by a guide arm on prior art concrete saws that would extend ahead of the rotating blade. A workman would physically move the entire saw as necessary to keep the guide arm on the chalk line. The expansion joint, once cut, was thereafter flushed to remove dust and other debris from it by air pressure, sand blasting or water flushing. The expansion joint was thereafter filled with a material such as silicon and/or caulk to seal it.

SUMMARY

A saw apparatus is disclosed for sawing paving slabs. The saw apparatus has a frame mounted on a ground contacting propulsion member such that the frame straddles above a slab to be cut without touching the slab. A first saw support assembly disposes one or more blades of a saw in cutting engagement with the slab for a transverse cut. A second saw support assembly disposes a blade of another saw in cutting engagement with the slab for a longitudinal cut. The saws are mounted on the saw assemblies and the saw assemblies are mounted on the frame and the frame is mounted on the ground contact propulsion members such that no part of said frame need contact the slab during cutting.

Certain embodiments of the invention include a feature of angling the first and second saw assemblies to cut an angled slot across the paving slab.

Certain embodiments of the invention include a feature of a second traverse-oriented saw support assembly configured to disposes a blade of another saw in cutting engagement with the slab for a second transverse cut.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
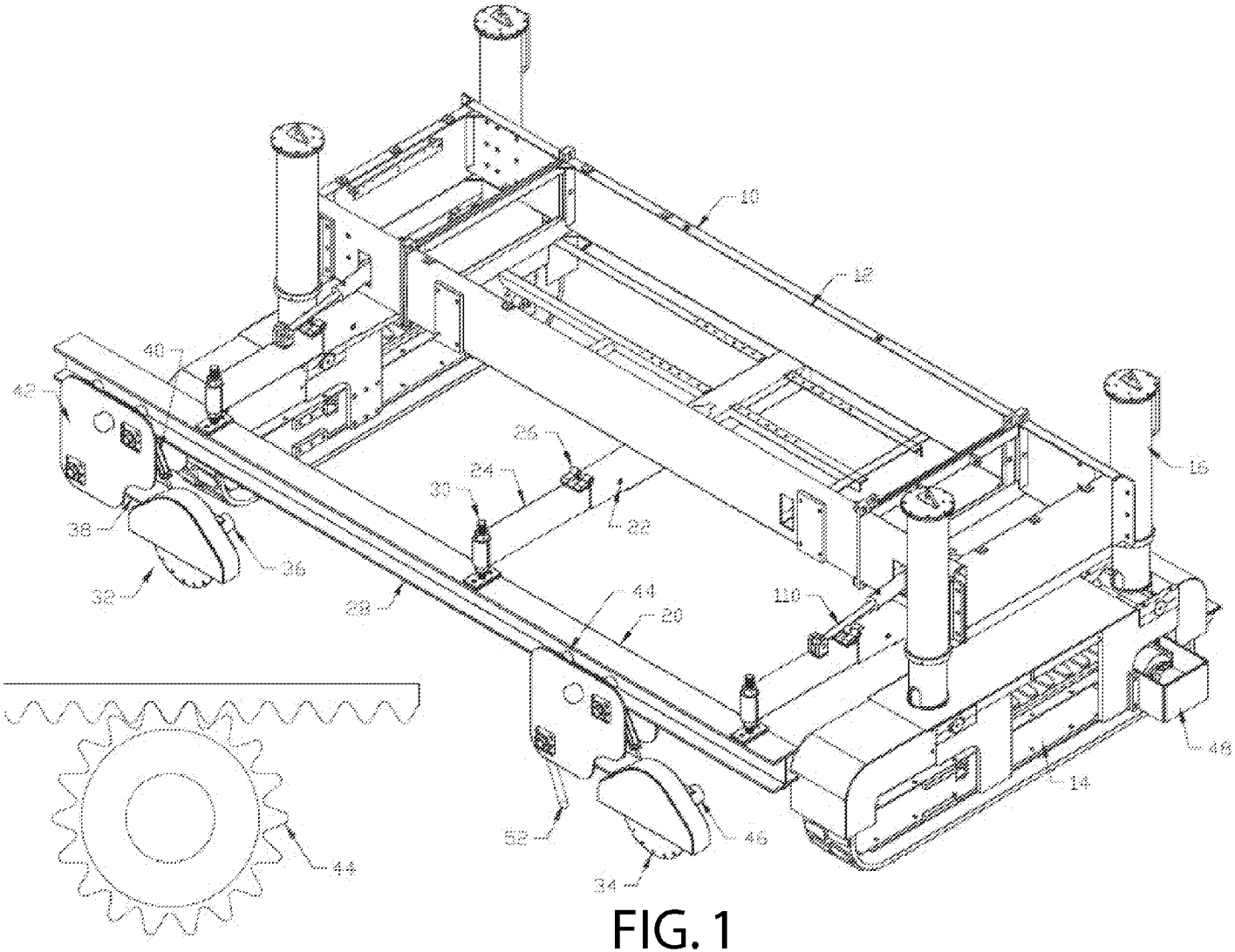
FIG. 1 is a perspective view of a concrete saw in an engaged position according to a first embodiment in accordance with the disclosure.

Referring now to the drawings wherein like numbers indicate like elements, a transverse frame 10 comprised of transverse frame beams 12 is provided for supporting the elements of the concrete saw. The entire apparatus is supported by ground contacting propulsion members, which in the depicted embodiment are a pair of tracks 14. Tracks 14 support the frame 10 in a position that does not contact the roadway slab being created. The tracks 14 are spaced sufficiently far apart so that the entire apparatus 10 straddles the roadway slab without the necessity of contacting it. The tracks of course may advance the frame 10 and the elements mounted on it along the length of the roadway in a continuous fashion without requiring disassembly and reassembly of the frame in each successive sawing location and without requiring other pieces of equipment to move the frame 10. Frame beams 12 may be unbolted and widened or shortened and re-assembled at the selected width in order to accommodate the dimension of the roadway to be paved before paving begins. Alternatively, hydraulic slides may be used to adjust width. Frame 10 is supported by support elements 16 which, in the depicted embodiment, are substantially vertical telescoping hydraulic cylinders 16.

Saw support assembly 20 is comprised of fixed support members 22 which in the depicted embodiment are longitudinal beams, and moving support members 24, which in the depicted embodiment are also longitudinally extending beams. These are attached by hinges 26 in the depicted embodiment. Transverse beam 28 is supported by moving support members 24 and fixedly attached to them. In the depicted embodiment, the attachment of the transverse beam 28 to moving support members 24 may be with adjustable attachments 30 so that a user can set a desired level of elevation for transverse beam 28 when it is to be deployed in an engaged position.

Mounted on transverse beam 28 is at least one concrete saw 32. The concrete saw 32 is comprised of a rotating disk 34 having a cutting edge. The rotating disk is mounted on an axle 36 which is in turn mounted on a saw support element 38 which may be raised and lowered to a user selected depth. Adjusting the depth of the cut in the depicted embodiment is achieved by adjusting the hydraulic height adjuster 40. The support element 38 and height adjuster 40 are pivotally mounted on a saw frame 42. Height adjustment may be controlled by an elevation wand 52, which may signal a movement of the saw above or below user selected thresholds for an acceptable height range.

Figure 3:
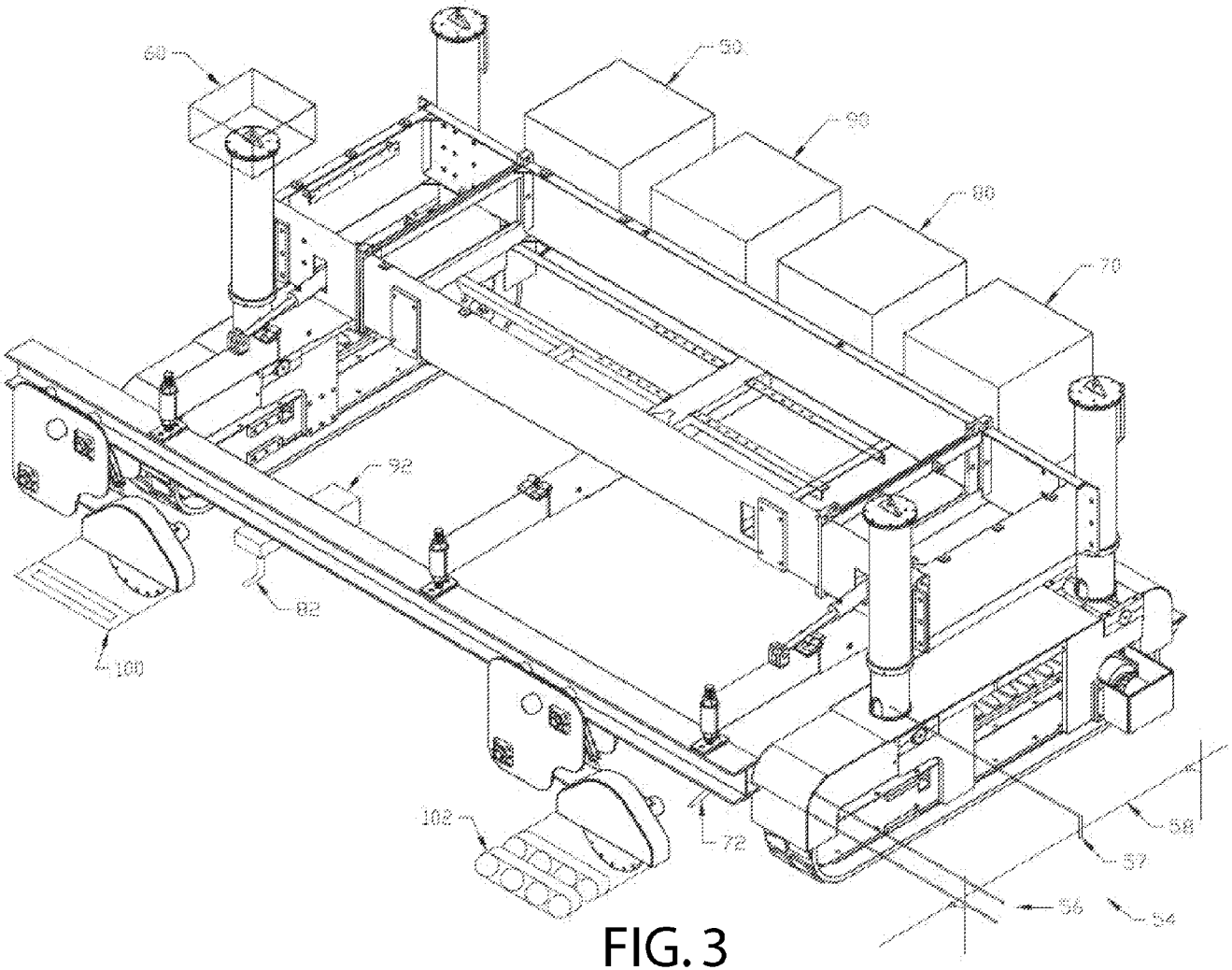
FIG. 3 is a perspective view of the concrete saw of FIG. 1, in accordance with the disclosure.
Figure 4:
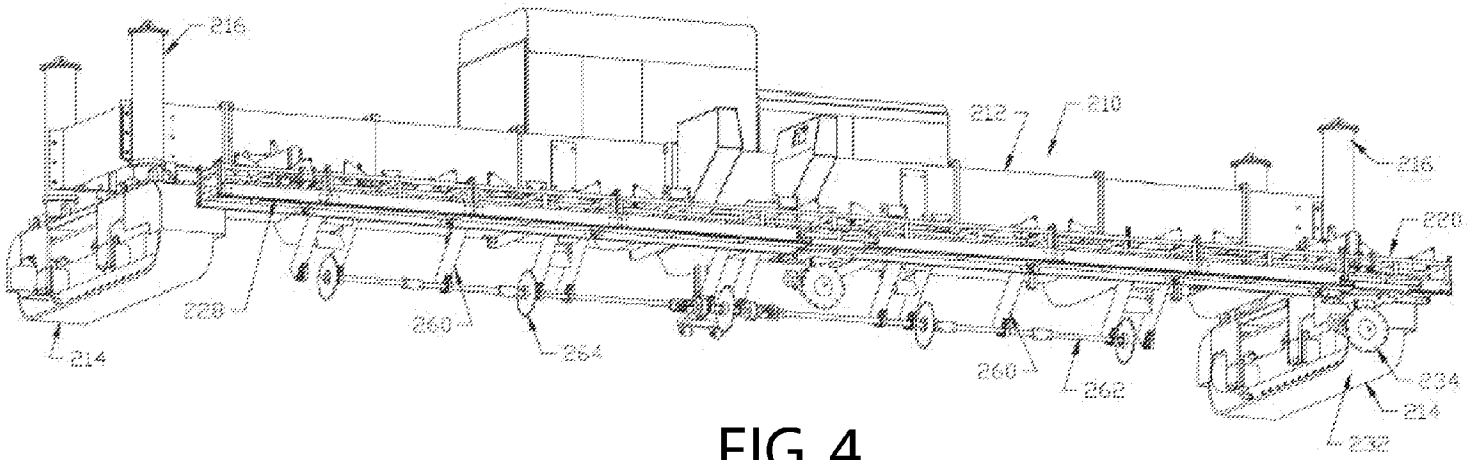
FIG. 4 is a front, bottom perspective view of a concrete saw according to a second embodiment, in accordance with the disclosure.
Figure 5:
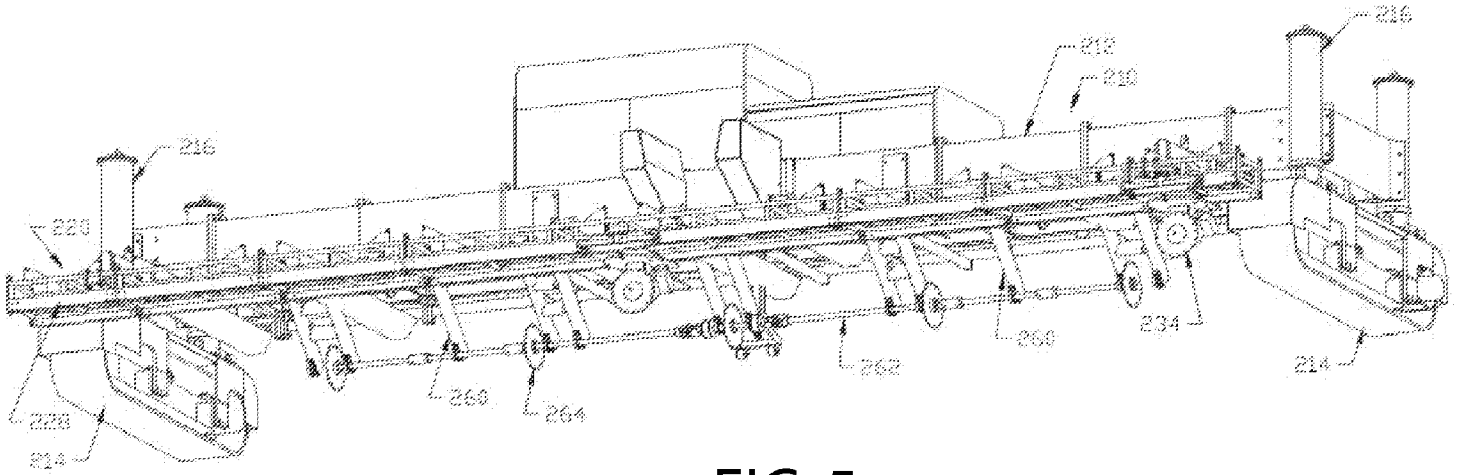
FIG. 5 is a front, bottom perspective view of the concrete saw from a different direction, in accordance with the disclosure.
Figure 6:
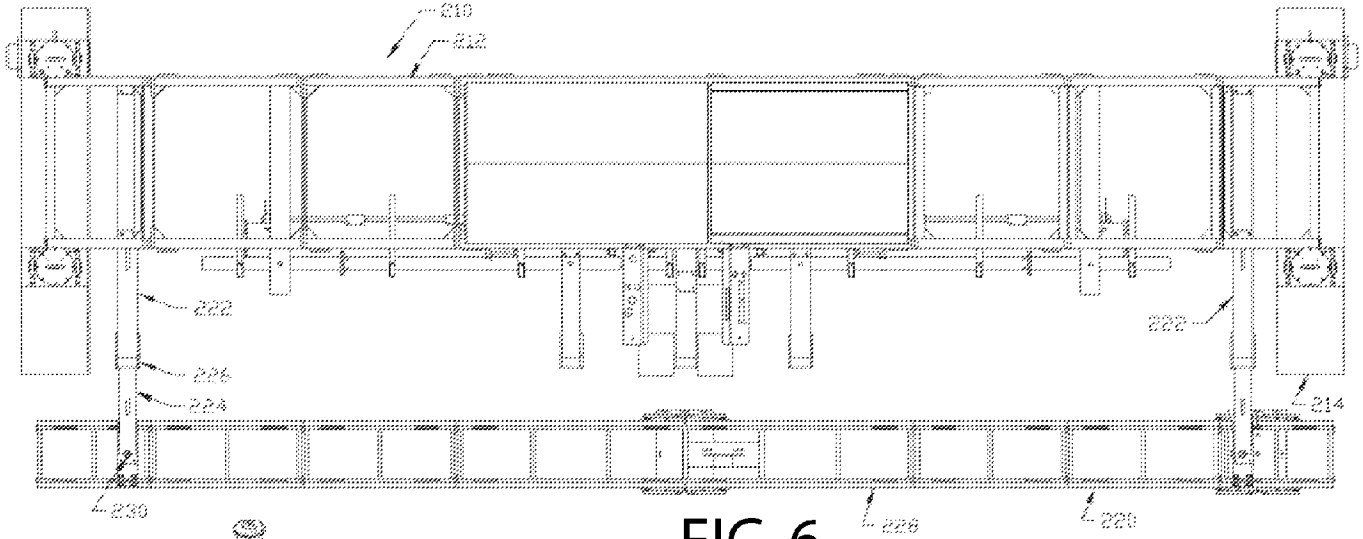
FIG. 6 is a top plan view of the concrete saw of FIGS. 4 and 5, in accordance with the disclosure.
Figure 7:
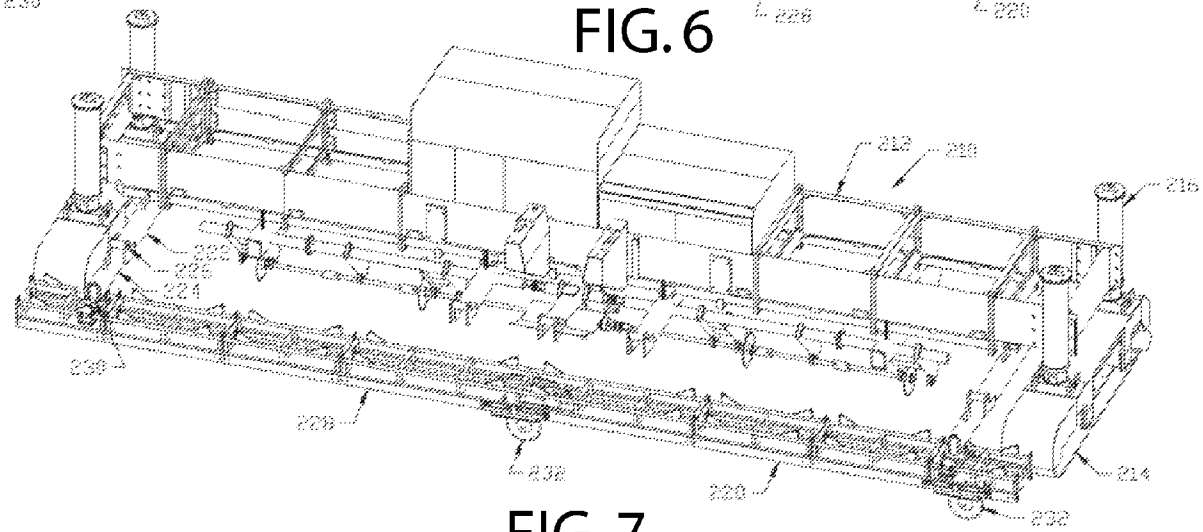
FIG. 7 is a top perspective view of the concrete saw of FIGS. 4-6, in accordance with the disclosure.
Figure 8:
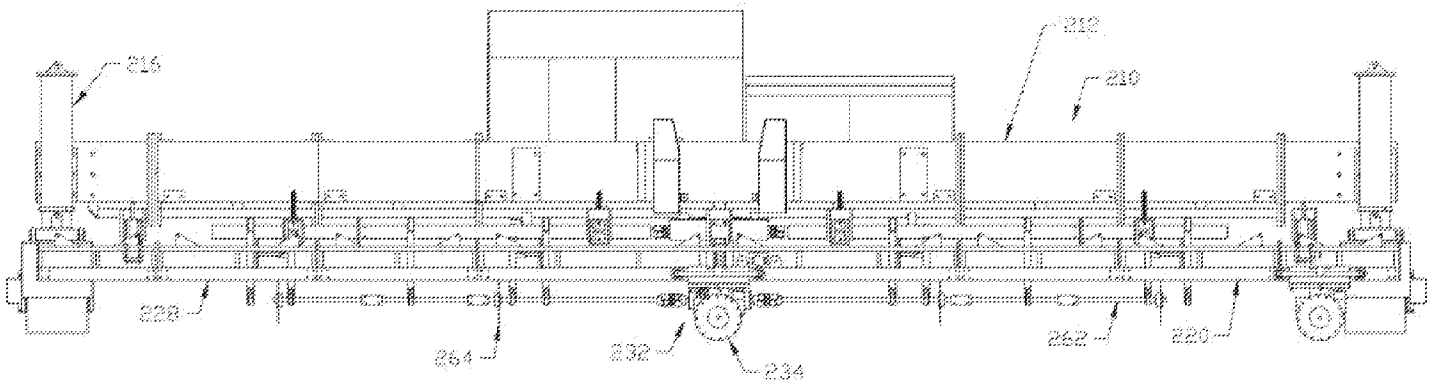
FIG. 8 is a front elevation view of the concrete saw of FIGS. 4-7, in accordance with the disclosure.
Figure 9:
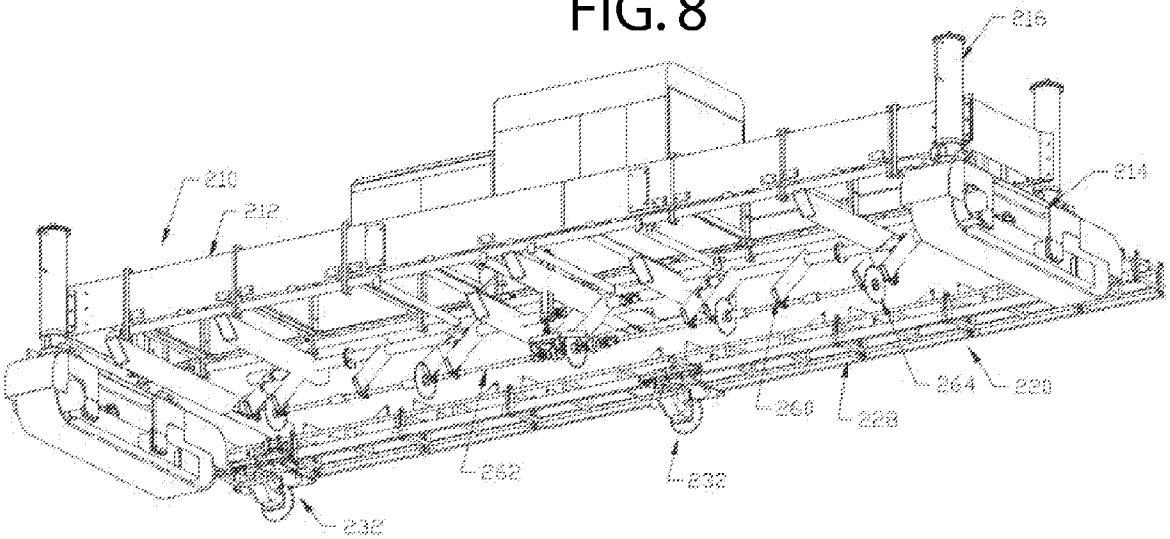
FIG. 9 is a rear, bottom perspective view of the concrete saw of FIGS. 4-8, in accordance with the disclosure.
Figure 10:
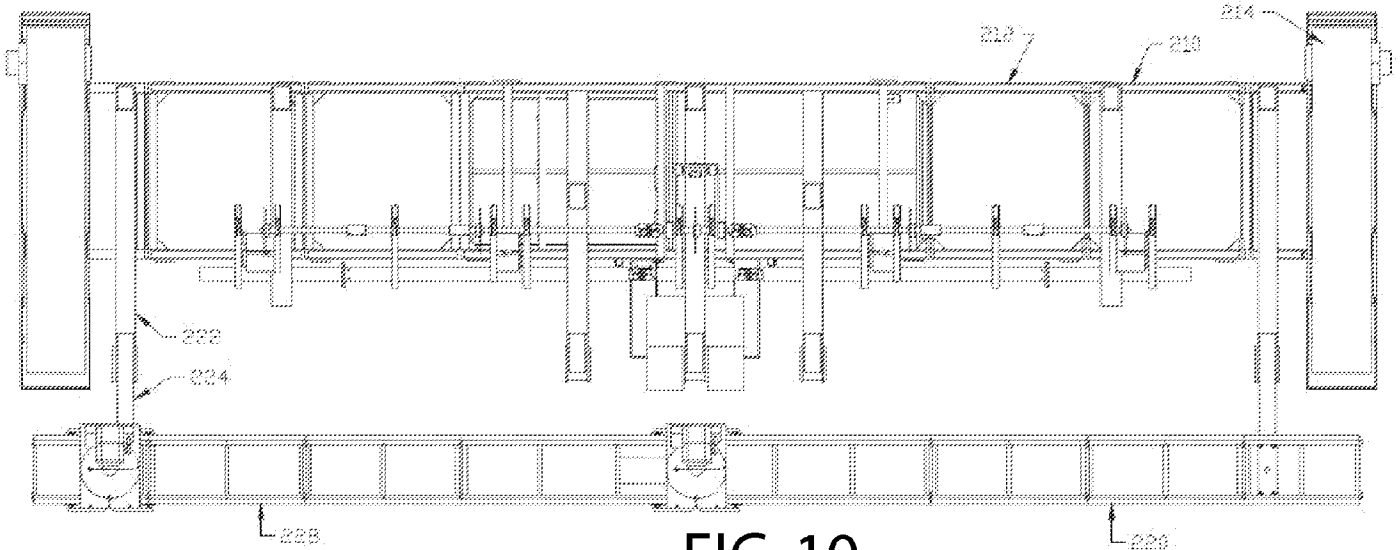
FIG. 10 is a bottom view of the concrete saw of FIGS. 4-9, in accordance with the disclosure.
Figure 11:
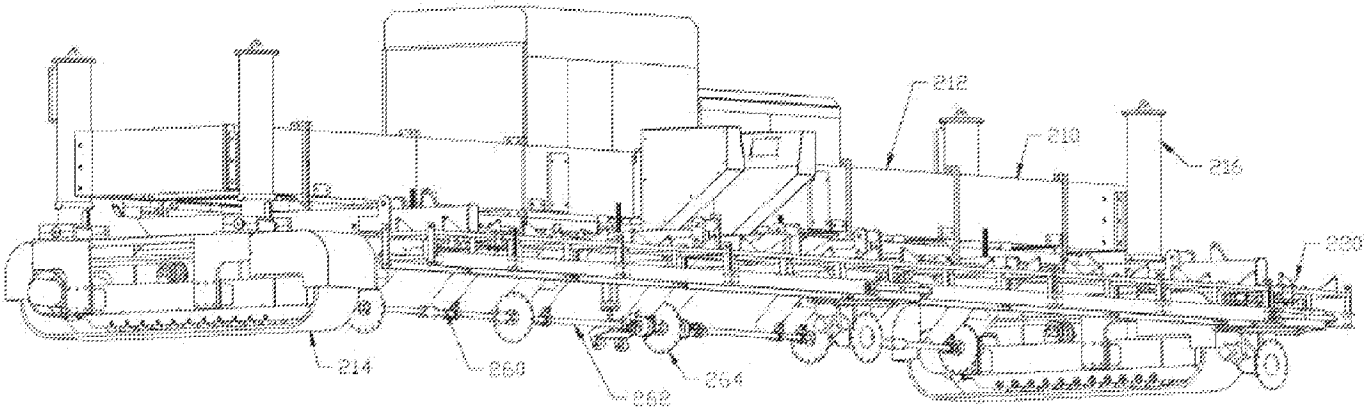
FIG. 11 is a ground-level perspective view of the concrete saw of FIGS. 4-10, in accordance with the disclosure.
Figure 12:
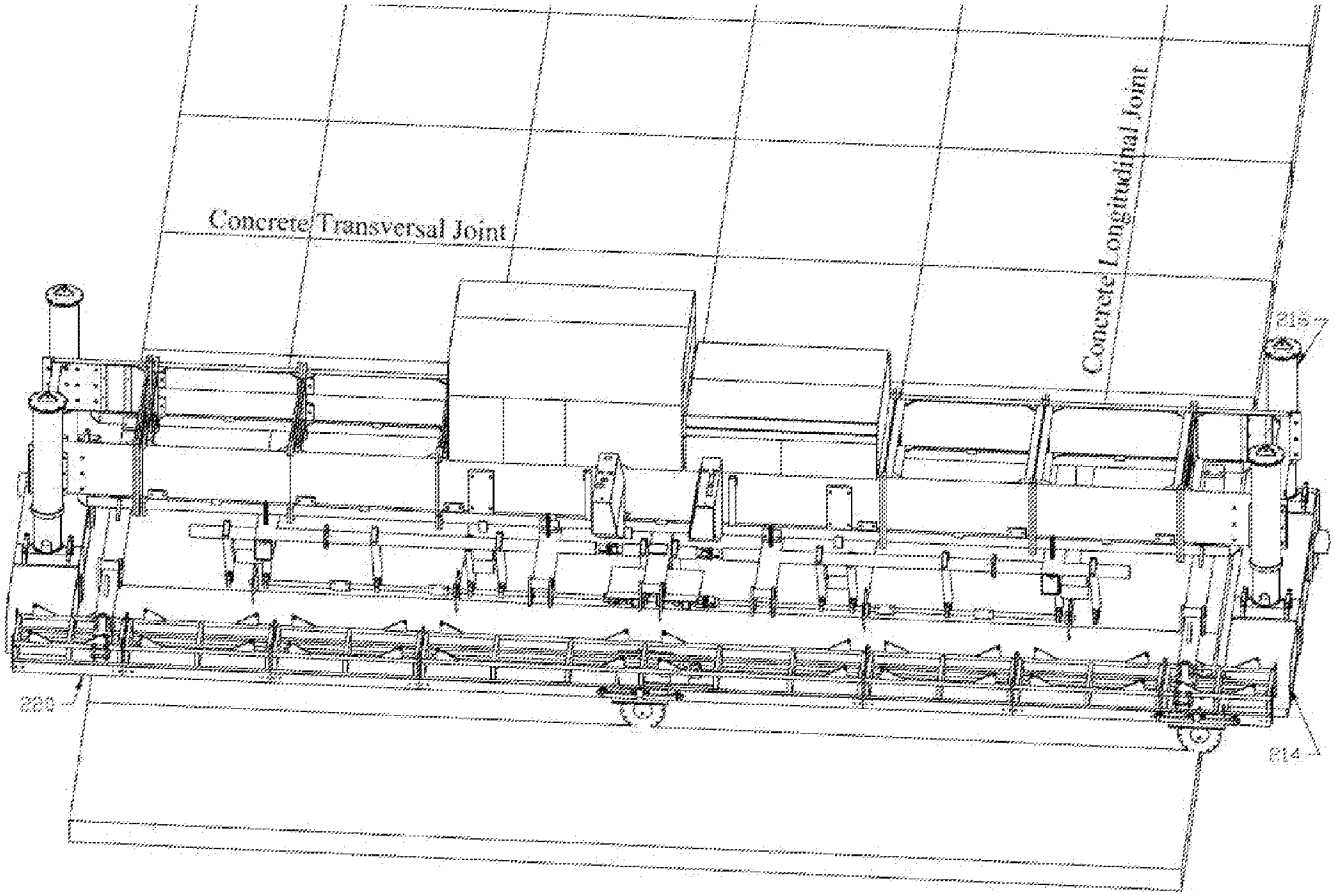
FIG. 12 is a top perspective view of the concrete saw showing the saw riding over a stretch of concrete and schematically illustrating the transverse and longitudinal joint cuts made by the saw, in accordance with the disclosure.

The saw frame 42 is mounted on transverse beam 28 in a manner to allow for transverse travel of the saw assembly 32 along the transverse beam 28. In the depicted embodiment, travel is mediated by a rack and pinion assembly 44. The saw must be powered and, in the depicted embodiment, power is via a hydraulic motor 46. Hydraulic motors for the saws 46 and other hydraulic motors 48 powering the tracks are powered by an engine 50 (FIG. 3). Two saws 32 may be mounted on the transverse beam 28 to further speed cutting, and/or to more accurately cut a crowned road.

A control system for the saw may include a servo controlled motor 46 to actuate translation. Saw speed may be controlled to respond to varying degrees of resistance encountered, as for example in response to the oil pressure in the hydraulic motor 46. Sawing speeds may be increased using the present invention, as the concrete may be less resistant due to the fact that it may be cut before it is entirely hardened. Spalling may be advantageously controlled for the same reason.

The saw may also have an anti-spalling device 100 used in conjunction with its cutting, which may be mounted with the saw. The depicted anti-spalling device 100 may be a template, or, alternatively a small track assembly 102. Either may be mounted on the saw assembly 32 or not.

Figure 2:
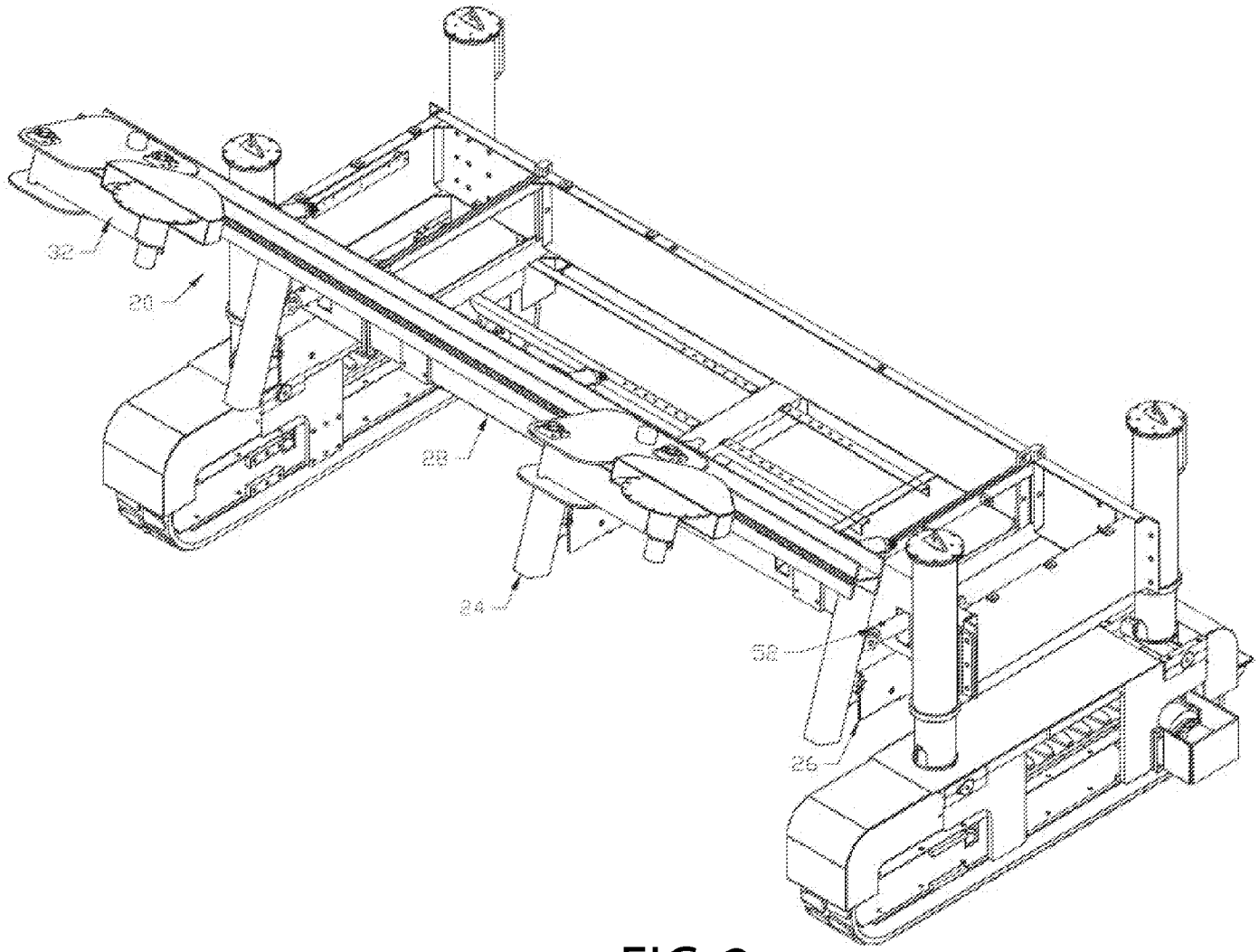
FIG. 2 is a perspective view of the concrete saw of FIG. 1 in a retracted position, in accordance with the disclosure.

The entire saw engagement assembly 20, is movable between an engaged position, such as shown in FIG. 1, that places the rotating disk 34 in cutting engagement with the surface of a poured slab, without any other portion of the apparatus touching the slab. The saw engagement assembly 20 also has a retracted position, such as depicted in FIG. 2. In the depicted embodiment, retraction is achieved by rotating the moving supported elements 24 around hinges 26 such that the transverse beam 28 and saw assemblies 32 lift away from engagement with the slab. Retraction may be actuated as depicted by a telescoping member 110.

In an alternative embodiment, each moveable support arm 24 may be extendable in a longitudinal direction along the direction of travel of the paving machine. By extending one or more support arms 24 varying degrees, the slab may be cut at an angle non-perpendicular to the roadbed, which is required to meet some construction specifications.

The concrete saw apparatus may incorporate a guidance system, thereby advantageously avoiding the short comings of the chalk line system. These shortcomings include the difficulty in cutting a straight line at the end of each cut as the guide arm extends off the edge of the poured slab. The guidance system may be a guide string wand feeler or a laser non ground contact system.

The depicted wand guidance system 54 is mounted to the frame 10 and disposed to engage a guide string 58 previously placed to parallel and indicate the direction and proper elevation of the roadway on one or both sides. The wands 56 may extend horizontally to engage the string vertically, top and/or bottom, to guide elevation. The wands 57 may extend vertically to engage the string horizontally, on either or both sides, to guide direction. An alternatively depicted laser guidance system 60 may have receptors mounted on the frame and disposed to receive guiding laser signals from lasers placed in positions in the field preconfigured to guide elevation and direction.

Guidance systems are available to assist in the sometimes desired practice of cutting expansion joint slots twice. This includes making a first pass to make a first narrower cut, and returning to that cut later with a second, wider saw blade to widen the cut. This practice controls the spalling characteristics of concrete, which vary over drying time. The retractability of the concrete saw support assembly 20 also facilitates this procedure which is advantageous in some circumstances.

The saw apparatus as depicted may be further deployed to advantageously execute other steps in the formation of expansion joints. This includes cooling the saw blade, which in the prior art was done by an extra worker hosing down the saw blade with water. In the depicted embodiment, a water reservoir 70 is provided, and a hose(s) 72 is disposed to spray cooling water on the saw blade. The hose 72 may be disposed to travel with the saw along the transverse beam 28.

The slot may be cleaned out by air pressure, water flushing or sand blasting, as selected by a user, with the use of the appropriate compressor 80, nozzle 82, and reservoir 70. The nozzle 82 may be disposed to travel along the transverse beam 28. In the alternative, the slot may be cleaned by vacuuming it out, in which case elements 80 and 82 may represent a vacuum and vacuum nozzle, respectively. The ability to immediately deploy a vacuum after applying cooling water or flushing water advantageously removes the resulting slurry of water and concrete dust, which is considered toxic in some circumstances.

Finally sealing equipment for injecting caulk, silicon, foam or other sealing material into the slot may be advantageously deployed on the frame, again with a reservoir 90 and injector 92. The injector 92 may be disposed to travel along the transverse beam 28.

In operation, a slab pour operation is set up with a roadbed, guidance system and paver provided. The saw of the present invention follows the paver along and over a poured slab by propelling itself on its tracks and supporting itself by ground contact only, without touching the slab. The saw is advanced to a preconfigured position for an expansion joint slot and the saw support assembly is moved from its retracted position to an engaged position with only the saw blade 34 contacting the surface of the slab. Sawing begins and proceeds to a user selected depth. The saw(s) move across the slab by translating along transverse beam 28. Supplementary procedures such as cooling the saw with water and flushing the slot may be done. When the slot is completely cut, the saw support assembly is retracted, the entire apparatus travels down the roadway as guided to the next preconfigured position for a slot to be cut and the process repeats. The apparatus may be returned to the slot positions for further supplemental procedures such as making a widening cut, flushing the slot or sealing it. It is within the scope of the present invention that the saw may be used to cut concrete, and also other paving materials.

FIGS. 4-13 illustrate a second embodiment. The embodiment of these figures is advantageously capable of executing longitudinal joint cuts in the concrete in addition to transverse cuts. This embodiment is similar in structure to the first embodiment described herein, and where reference is made to corresponding components, the same reference number with the addition of "2" will be used. A transverse frame 210 comprised of transverse frame beams 212 is provided for supporting the elements of the concrete saw. The entire apparatus is supported by ground contacting propulsion members, which in the depicted embodiment are a pair of tracks 214. Tracks 214 support the frame 210 in a position that does not contact the roadway slab being created. The tracks 214 are spaced sufficiently far apart so that the entire apparatus 210 straddles the roadway slab without the necessity of contacting it. The tracks of course may advance the frame 210 and the elements mounted on it along the length 9 of the roadway in a continuous fashion without requiring disassembly and reassembly of the frame in each successive sawing location and without requiring other pieces of equipment to move the frame 210. Frame beams 212 may be unbolted and widened or shortened and reassembled at the selected width in order to accommodate the dimension of the roadway to be paved before paving begins. Alternatively, hydraulic slides may be used to adjust width. Frame 210 is supported by support elements 216 which, in the depicted embodiment, are substantially vertical telescoping hydraulic cylinders 216.

Saw support assembly 220 is comprised of fixed support members 222 which in the depicted embodiment are longitudinal beams, and moving support members 224, which in the depicted embodiment are also longitudinally extending beams. These are attached by hinges 226 in the depicted embodiment. Transverse beam 228 is supported by moving support members 224 and fixedly attached to them. In the depicted embodiment, the attachment of the transverse beam 228 to moving support members 224 may be with adjustable attachments 230 so that a user can set a desired level of elevation for transverse beam 228 when it is to be deployed in an engaged position.

Mounted on transverse beam 228 is at least one concrete saw 232. The concrete saw 232 is comprised of a rotating disk 234 having a cutting edge. The rotating disk is mounted on an axle which is in turn mounted on a saw support element which may be raised and lowered to a user selected depth. Adjusting the depth of the cut in the depicted embodiment is achieved by adjusting the hydraulic height adjuster. The support element and height adjuster are pivotally mounted on a saw frame.

The saw frame is mounted on transverse beam 228 in a manner to allow for transverse travel of the saw assembly 232 along the transverse beam 228. In the depicted embodiment, travel is mediated by a rack and pinion assembly. The saw must be powered and, in the depicted embodiment, power is via a hydraulic motor. Hydraulic motors for the saws and other hydraulic motors powering the tracks are powered by an engine. Two saws 232 may be mounted on the transverse beam 228 to further speed cutting, and/or to more accurately cut a crowned road.

This embodiment further incorporates a series of pivoting support members 260 extending downwardly and toward the rear of the saw. The pivoting support members are connected to and supported by a transverse beam 261 running along the width of the apparatus. In one version of this embodiment, these pivoting members carry an axle 262, which in turn supports and turns one or more longitudinally cutting saws 264. The longitudinally cutting saws 264 may be driven in a manner similar to the transverse cutting saw 232. The pivoting support members 260 are provided with a control mechanism to enable the support members 260 to be raised and lowered relative to the frame, by rotation of the transverse beam 261, to control engagement of the longitudinally cutting saws 264 with the surface of the concrete.

In an alternate version of this embodiment, each pivoting member 260 carries a longitudinally cutting saw 264. Each of the longitudinally cutting saws 264 is powered by a separate hydraulic motor such that each saw 264 may be turned on and off independently of the other saws 264. Each pivoting support member 260 is mounted on the transverse beam 261 by a clamp that may be selectively loosened to allow for horizontal positional adjustment of the support members 260, and hence the saws 264, along the length of the transverse beam 261 and then retightened to secure the support members 260 in position. This allows for selective adjustment of the positioning and separation of the saws 264 along the machine and, accordingly, of the resulting longitudinal cuts imparted to the concrete slab. The 11 clamping mounting arrangement of the support members 260 also allows for vertical adjustment of the members 260 and, therefore, the saws 264.

Figure 13:
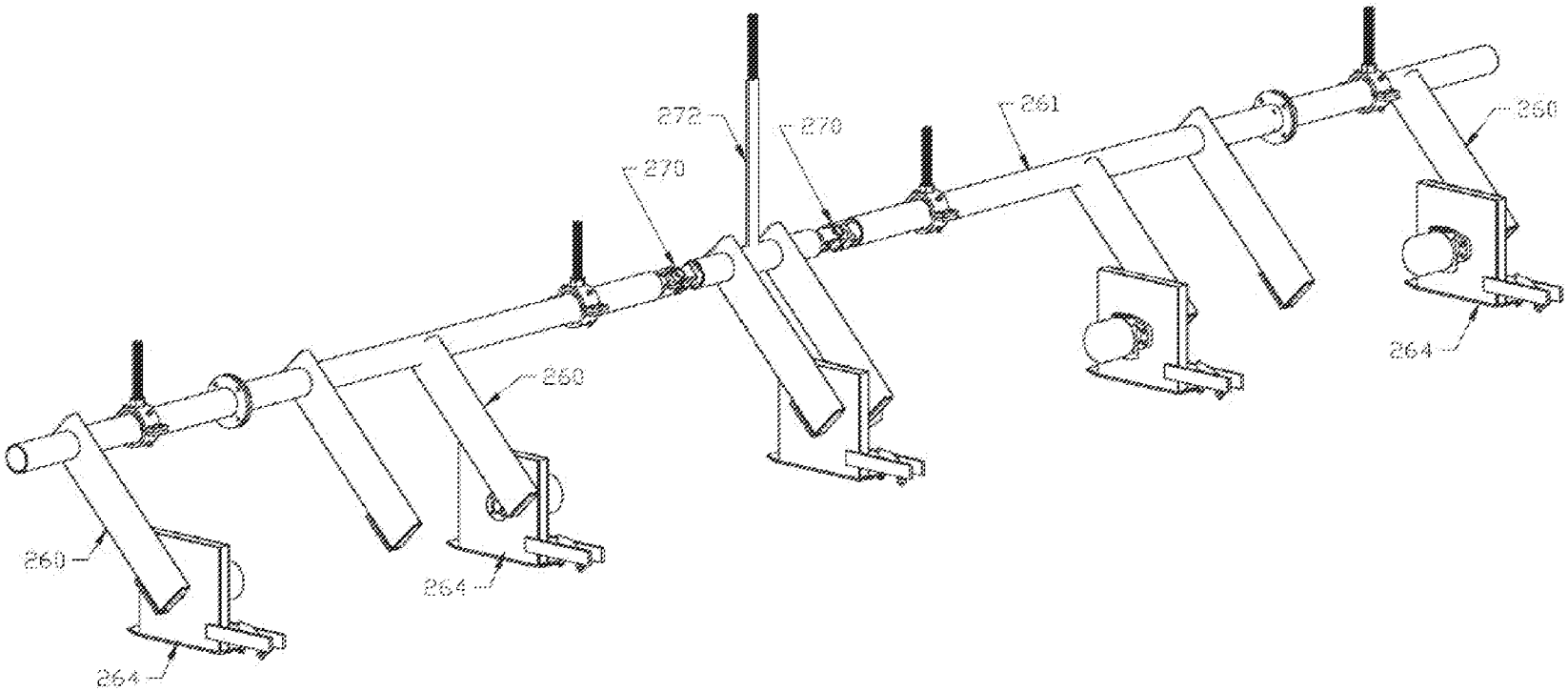
FIG. 13 is a perspective view isolating an longitudinal cutting saw arrangement, in accordance with the disclosure.
Figure 14:
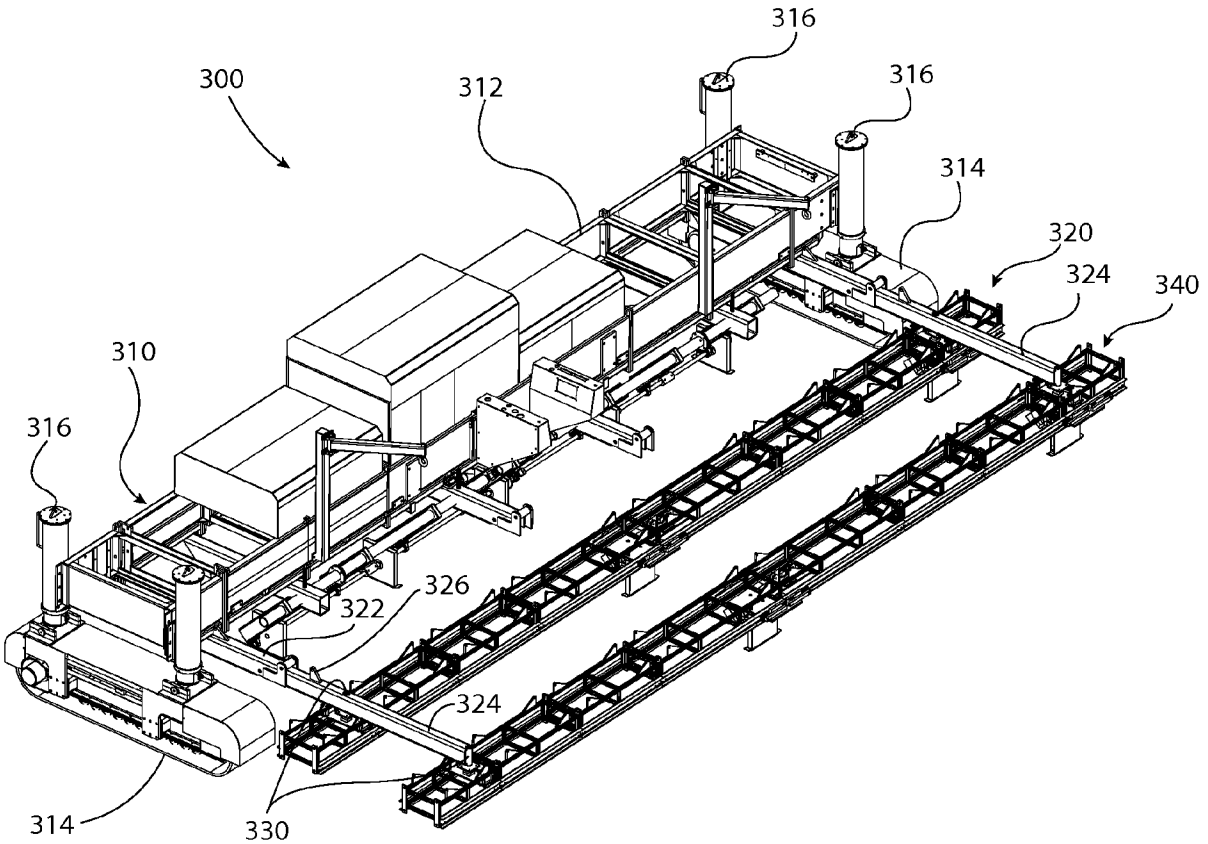
FIG. 14 is a perspective view of a third embodiment of the saw apparatus including the first and second saw support assemblies, in accordance with the disclosure.
Figure 15:
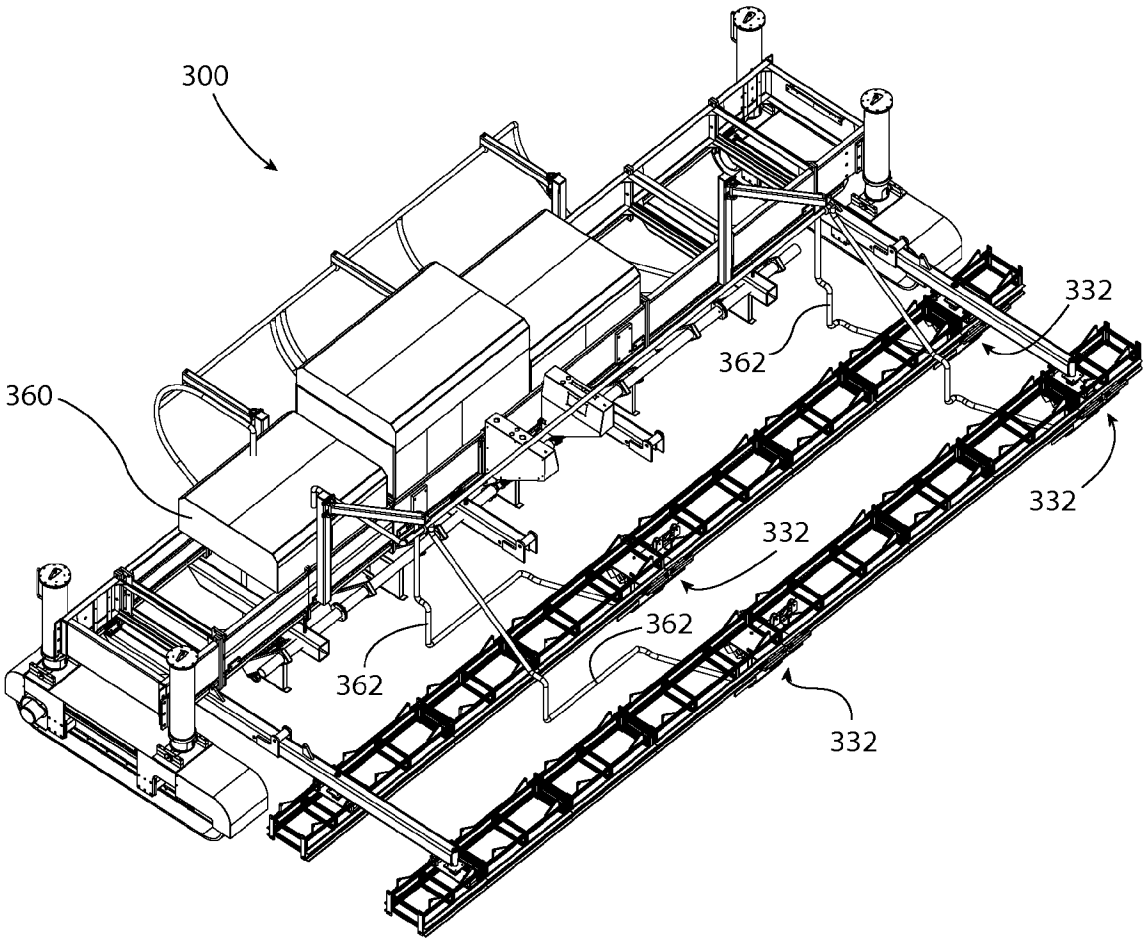
FIG. 15 is a perspective view of a third embodiment of the saw apparatus depicting a slot cleaning and sealant system along with the first, second, and third saw support assemblies, in accordance with the disclosure.
Figure 16:
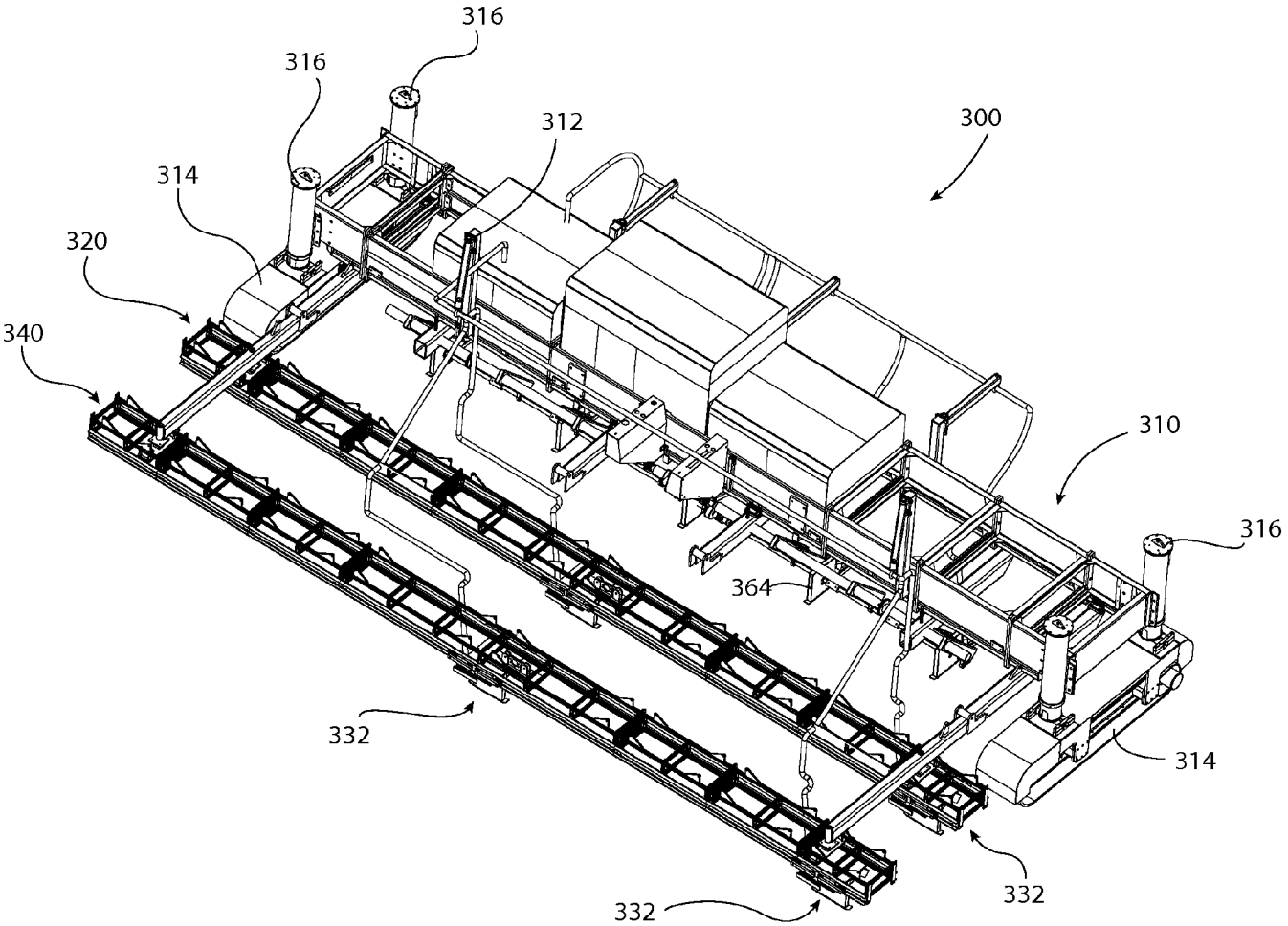
FIG. 16 is a right side perspective view of a third embodiment of the saw apparatus depicting a slot cleaning and sealant system along with the first, second, and third saw support assemblies, in accordance with the disclosure.
Figure 17:
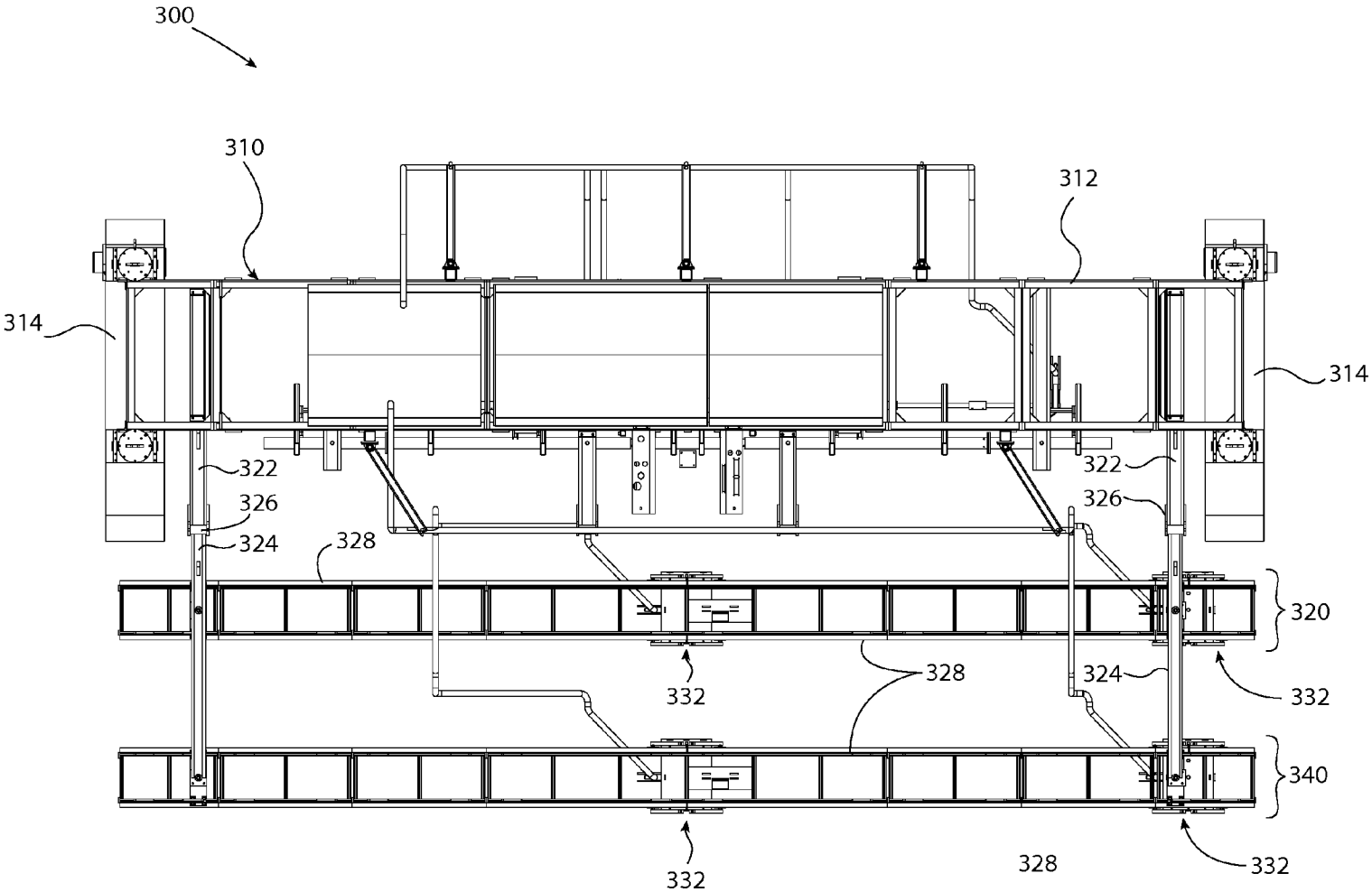
FIG. 17 is an elevated plan view of a third embodiment of the saw apparatus, in accordance with the disclosure.
Figure 18:
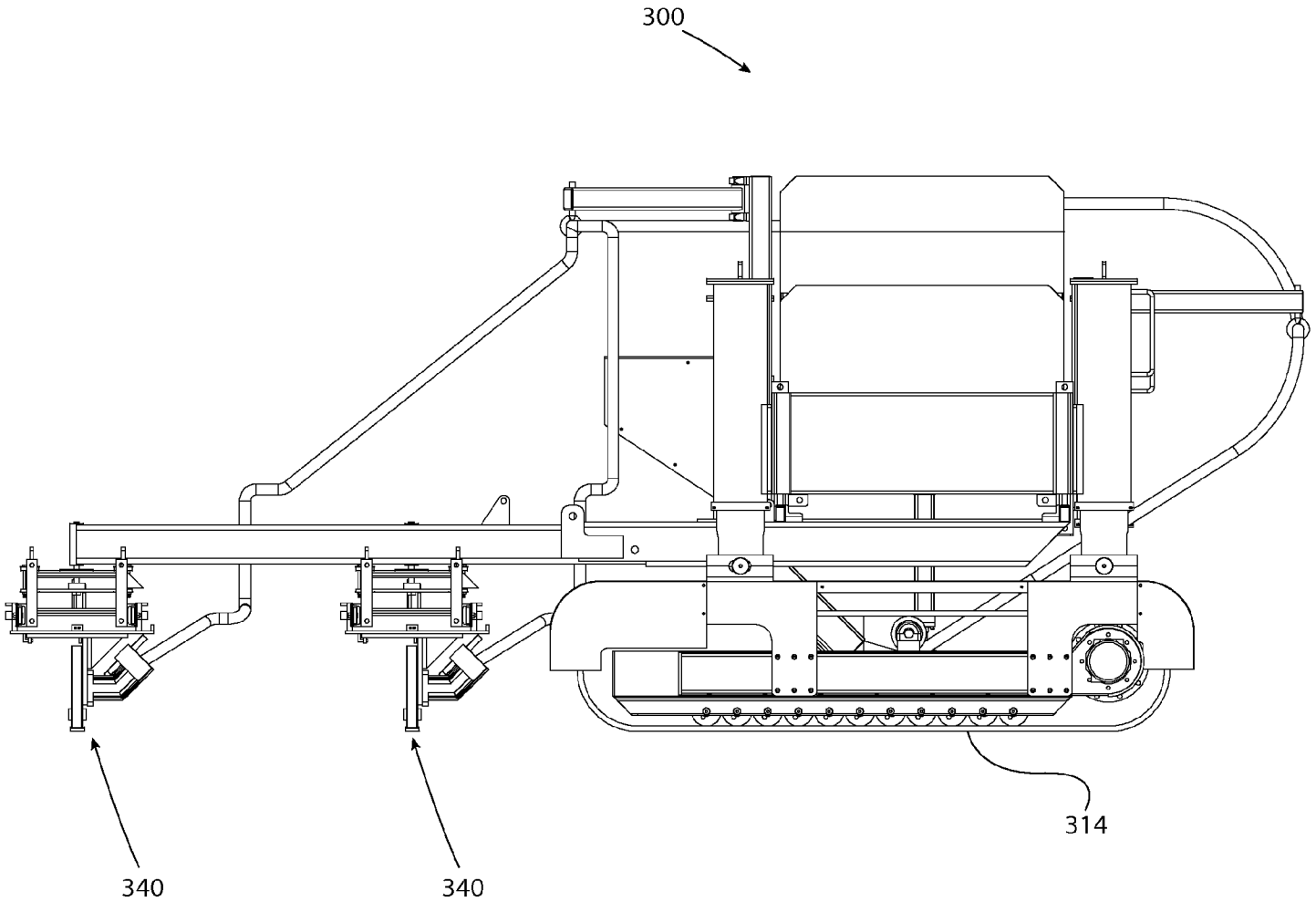
FIG. 18 is a right side view of a third embodiment of the saw apparatus, in accordance with the disclosure.
Figure 19:
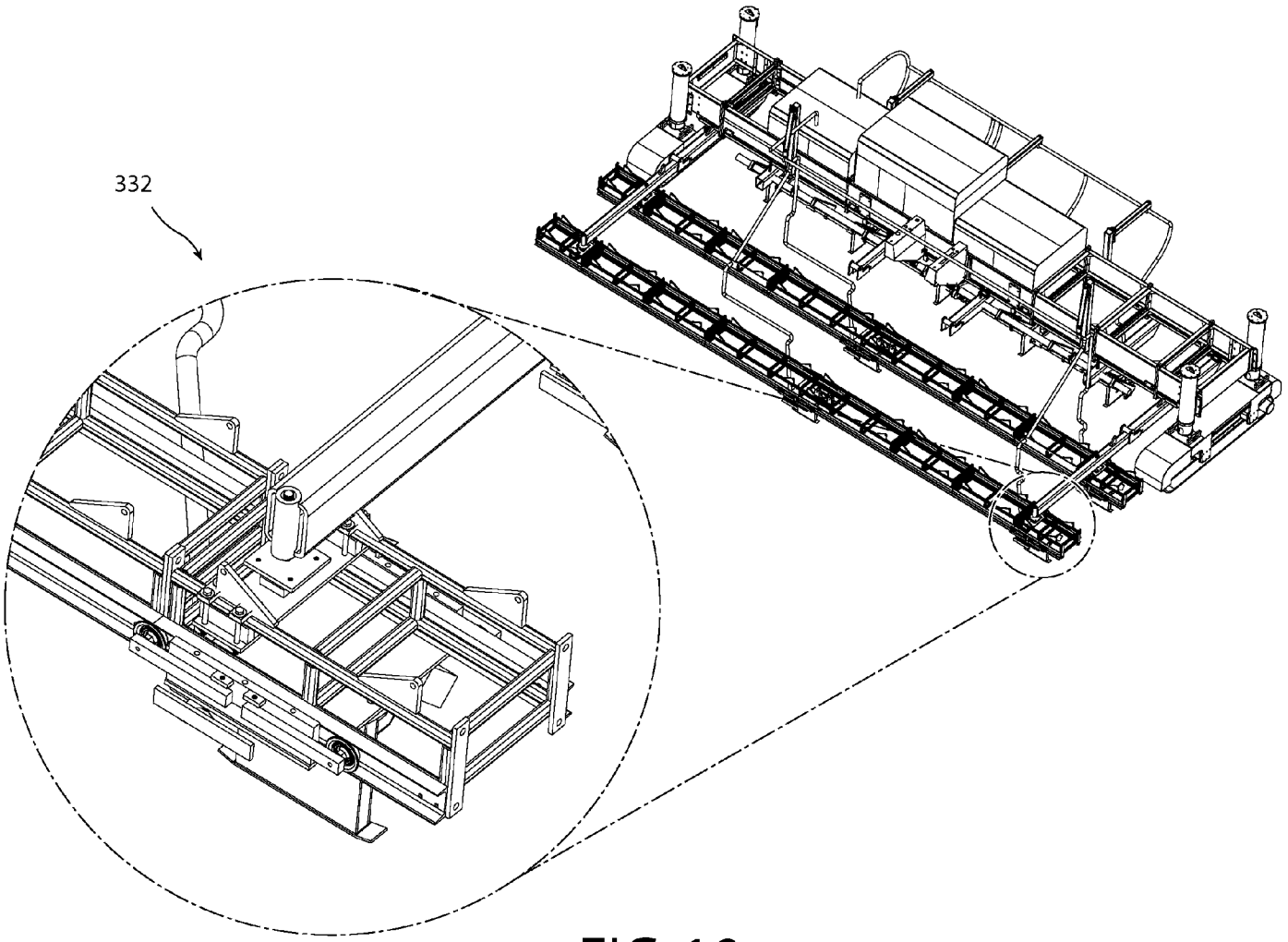
FIG. 19 is a side view of a saw assembly of the saw apparatus, in accordance with the disclosure.

In an embodiment illustrated in FIG. 13, the transverse beam 261 is supported on the apparatus at each end and at the approximate center of the beam. Further, the beam is composed of two halves joined by a pivot at the approximate midpoint of the transverse beam 261 to the apparatus. In the illustrated embodiment, the pivot is composed of two pivoting joints 270 located on either side of a short center section of beam. This arrangement allows for a support member 260 and saw to be positioned at the midpoint of the transverse beam, which is commonly required location for a longitudinal joint in a slab, while still allowing the adjustment described below.

Advantageously, the midpoint of the transverse beam 261 is provided with a vertical adjustment cylinder 272 that raises and lowers the center of the transverse beam 261. At the same time, the two ends of the transverse beam 261 are held in a fixed vertical position relative to the apparatus, although the height of the beam ends may also be adjusted, for example in between operation of the apparatus. During operation, sensors determine variations in height of the concrete slab and, more particularly, the degree of crown present in the slab. In response to signals from these sensors, the midpoint of the transverse beam 261 is raised and lowered. If the ends of the transverse beam 261 are kept fixed, this adjustment of the midpoint of the beam 261 introduces a gradation in the height of the saws 264 along its length: lower at the ends and higher as the center point of the beam 261 is approached. This generally matches the positioning of the saws relative to the crown of the concrete slab. Alternately, if the slab is generally flat with no crown, the transverse beam 261 will be placed into a generally flat and level condition along its entire length.

It can therefore be seen that this embodiment is capable of executing, in a sequential manner, both longitudinal and transverse cuts in a concrete surface, and adjusting for various degrees of crowning along the surface, without the need for multiple machines and without contacting the concrete surface, except for the saws, to avoid marring the surface prior to complete curing.

In operation, a slab pour operation is set up with a roadbed, guidance system and paver provided. The saw of the present invention follows the paver along and over a poured slab by propelling itself on its tracks and supporting itself by ground contact only, without touching the slab. The saw is advanced to a preconfigured position for an expansion joint slot and the saw support assembly is moved from its retracted position to an engaged position with only the saw blade 34 contacting the surface of the slab. Sawing begins and proceeds to a user selected depth. The saw(s) move across the slab by translating along transverse beam 28. Supplementary procedures such as cooling the saw with water and flushing the slot may be done. When the slot is completely cut, the saw support assembly is retracted, the entire apparatus travels down the roadway as guided to the next preconfigured position for a slot to be cut and the process repeats. The apparatus may be returned to the slot positions for further supplemental procedures such as making a widening cut, flushing the slot or sealing it. It is within the scope of the present invention that the saw may be used to cut concrete, and also other paving materials.

In the case of embodiments provided with longitudinally cutting saws, the procedure is similar; however, the longitudinal expansion joint slots are cut as the saw advances on its tracks. Since the saw generally moves while creating longitudinal slots and remains in a single position while transverse slots are cut, these two operations will generally be carried out sequentially rather than simultaneously.

FIGS. 14-19 illustrate a third embodiment of the apparatus 300. The embodiment of these figures is advantageously capable of executing longitudinal joint cuts in the concrete in addition to transverse cuts. This embodiment is similar in structure to the first and second embodiments described hereinabove, and where reference is made to corresponding components, the same reference number with the addition of "3" will be used.

A frame 310 comprised of transverse frame beams 312 is provided for supporting the elements of the concrete saw. The entire apparatus is supported by ground contacting propulsion members, which in the depicted embodiment are a pair of tracks 314. Tracks 314 support the frame 310 in a position that does not contact the roadway slab being created. The tracks 314 are spaced sufficiently far apart so that the entire apparatus 310 straddles the roadway slab without the necessity of contacting it. The tracks of course may advance the frame 310 and elements mounted on it along the length of the roadway in a continuous fashion without requiring disassembly and reassembly of the frame in each successive sawing location and without requiring other pieces of equipment to move the frame 310. Frame beams 312 may be unbolted and widened or shortened and reassembled at the selected width in order to accommodate the dimension of the roadway to be paved before paving begins. Alternatively, hydraulic slides may be used to adjust width. Frame 310 is supported by support elements 316 which, in the depicted embodiment, are substantially vertical telescoping hydraulic cylinders.

The apparatus 300 includes a first and second saw support assembly 320 and 340, respectively. Fixed support members 322 attach the first and second saw support assemblies 320 and 340 to the frame 310. As depicted, the fixed support members 322 are longitudinal beams. The fixed support members 322 may be integral or formed of many beam members. In one embodiment, as depicted, the fixed support members include moving support members 324, which in the depicted embodiment are also longitudinally extending beams. Moving support members 324 are mechanically attached preferably using hinges 326. In this way, the first and second saw support assembly may pivot at the hinge point for engagement and disengagement to a concrete surface during operation. One or more traverse beams 328 are supported by moving support members 324. In the depicted embodiment, the attachment of the transverse beam 328 to moving support members 324 may be with adjustable attachments 330 so that a user can set a desired level of elevation for transverse beam 328 when it is to be deployed in an engaged position.

Mounted on the first and second saw support assemblies 320 and 340 is at least one concrete saw assembly 332. The concrete saw assembly 332 includes a rotating disk having a cutting edge. The rotating disk may be mounted on an axle which is in turn mounted on a saw support element which may be raised and lowered to a user selected depth. Adjusting the depth of the cut in the depicted embodiment is achieved by adjusting the hydraulic height adjuster. The support element and height adjuster are pivotally mounted on a saw frame.

The saw frame is mounted on transverse beam 328 in a manner to allow for transverse travel of the saw assembly 332 along the transverse beam 328. In the depicted embodiment, travel is mediated by a rack and pinion assembly. The saw must be powered and, in the depicted embodiment, power is via a hydraulic motor. Hydraulic motors for the saws and other hydraulic motors powering the tracks are powered by an engine. In one embodiment, two saw assemblies 332 may be mounted on each saw support assembly 320 and 340 to further speed cutting, and/or to more accurately cut a crowned road.

The apparatus 300 further includes a housing 360 configured to contain a compressor, vacuum, and sealant container. In one embodiment, a coolant reservoir may be additionally included. A tubing system 362 is configured to transport coolant, sealant, and pressurized gas proximate each saw assembly 332. In one embodiment, the tubing system is configured to transport debris using a vacuum. The tubing system may include a number of individual hoses or tubes to each saw assembly 332. For example, a coolant tube may be utilized to transport water from a reservoir to the saw disc, a vacuum tube may transport debris from the sawing area, and a sealant tube may apply sealant to the cut concrete. A fourth tube may apply pressurized air to the cut concrete to scatter cut debris before applying sealant. In one embodiment, a tube may be configured to perform multi-functions. For example, a tube may be configured to selectively apply pressurized gas to the cut and then transporting coolant to the saw. The tubing system is configured to travel with the saw assemblies along the associated saw assembly.

At each saw assembly 332, components of the tubing system 362 may be connected to a sealant applicator and an air pressure line nozzle. The sealant applicator and the nozzle may be disposed on a mounting bracket of the saw assembly 332. In an alternative embodiment, the sealant, and cleaning system may be configured to traverse an associated saw support assembly independent of the saw assemblies 332. As described herein above, the cut slot may be cleaned out by air pressure, water flushing or sand blasting, as selected by a user, with the use of the appropriate compressor, nozzle, and reservoir. In the alternative, the cut slot may be cleaned by vacuuming it out, in which case element may represent a vacuum nozzle.

Similar to the operation of the above embodiment, a slab pour operation is set up with a roadbed, guidance system and paver provided. The saw 300 follows the paver along and over a poured slab by propelling itself on its tracks and supporting itself by ground contact only, without touching the slab. The apparatus 300 is advanced to a preconfigured position for an expansion joint slot and the first and second saw support assemblies 320 and 340 are moved from its retracted position to an engaged position with only the saw blade contacting the surface of the slab. Sawing begins along two traversing axes, concurrently or sequentially, to a user selected depth. Supplementary procedures such as cooling the saw with water and flushing the slot may be done. When the slot is completely cut, the saw support assembly is retracted, the entire apparatus travels down the roadway as guided to the next preconfigured position for a slot to be cut and the process repeats. The apparatus may be returned to the slot positions for further supplemental procedures such as making a widening cut, flushing the slot or sealing it. It is within the scope of the present invention that the saw may be used to cut concrete, and also other paving materials.

Further, similar to the second embodiment described herein above with reference to FIGS. 4-13, the third embodiment may include a series of longitudinally cutting saws 364. As above, it can therefore be seen that this embodiment is capable of executing, in a sequential manner, both longitudinal and transverse cuts in a concrete surface, and adjusting for various degrees of crowning along the surface, without the need for multiple machines and without contacting the concrete surface, except for the saws, to avoid marring the surface prior to complete curing.

FIGS. 20-24 illustrate an additional embodiment of the apparatus 400. This embodiment is advantageously capable of executing longitudinal and transverse cuts, although it is contemplated that the apparatus 400 may be configured to cut either longitudinally or transversely in alternate embodiments. The apparatus 400 includes a saw assembly 432 having a cleaning and treatment system configured to sequentially vacuum, blow, insert filler material, i.e., backer material, and apply a sealant during a single pass along the concrete slab. This embodiment includes structure similar to the first, second, and third embodiments described hereinabove, and where reference is made to corresponding components, the same reference number with the addition of "4" will be used.

Figure 20:
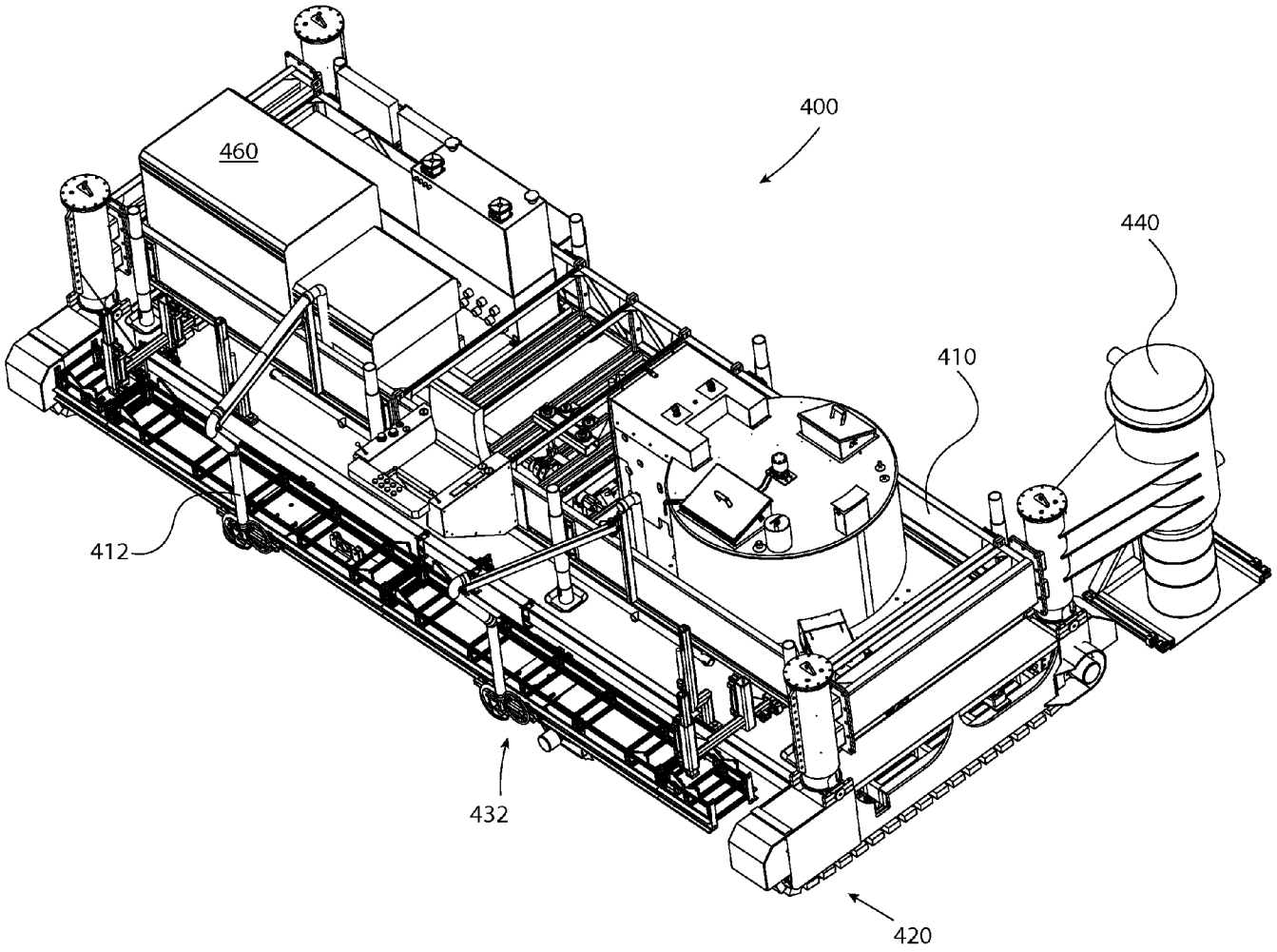
FIGS. 20-24 depict a fourth embodiment of the saw apparatus having saw assemblies configured to cut, vacuum, clean via pressurized air, fill a cut slot, and apply sealant to a cut slot concurrently, in accordance with the disclosure.
Figure 21:
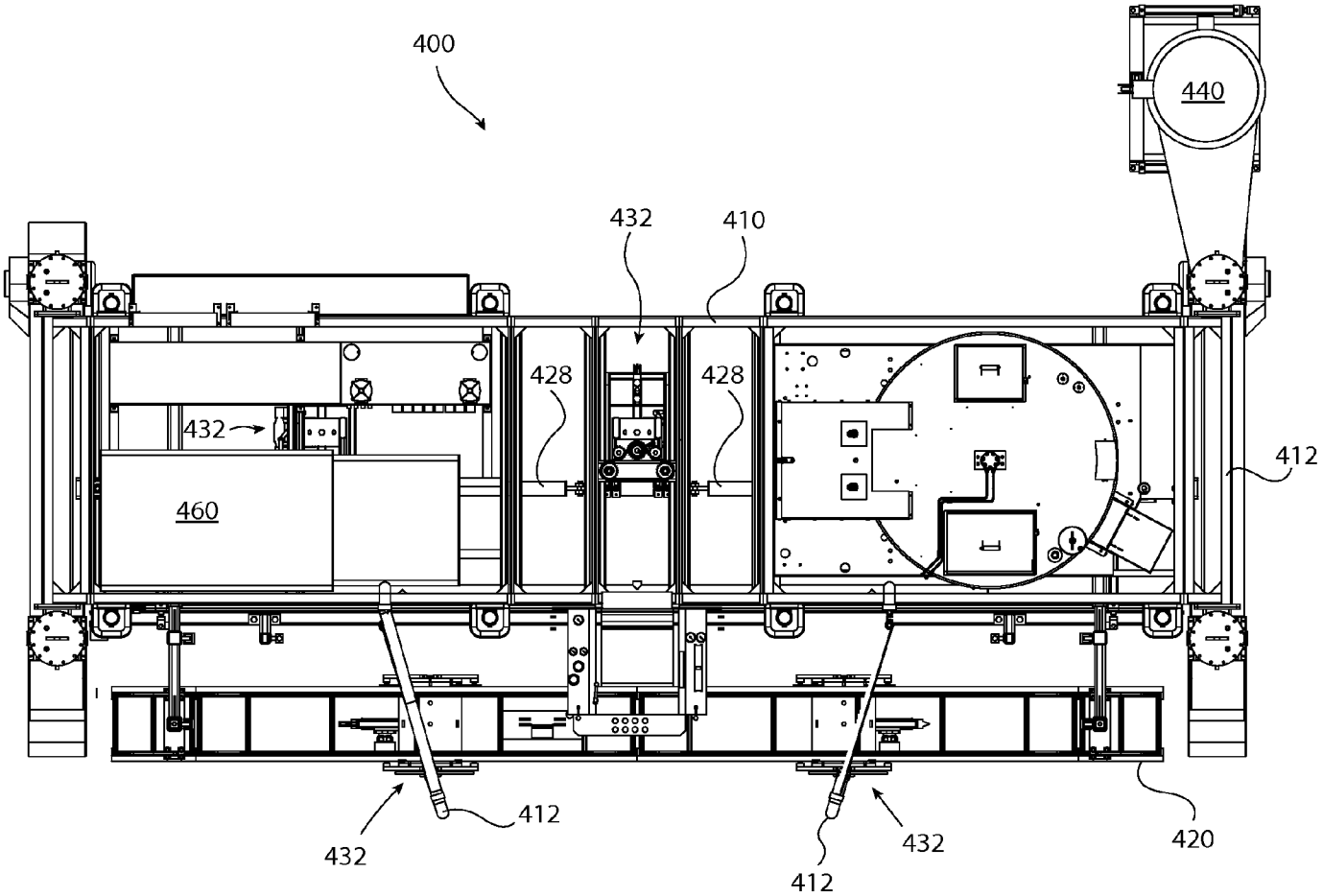
Figure 22:
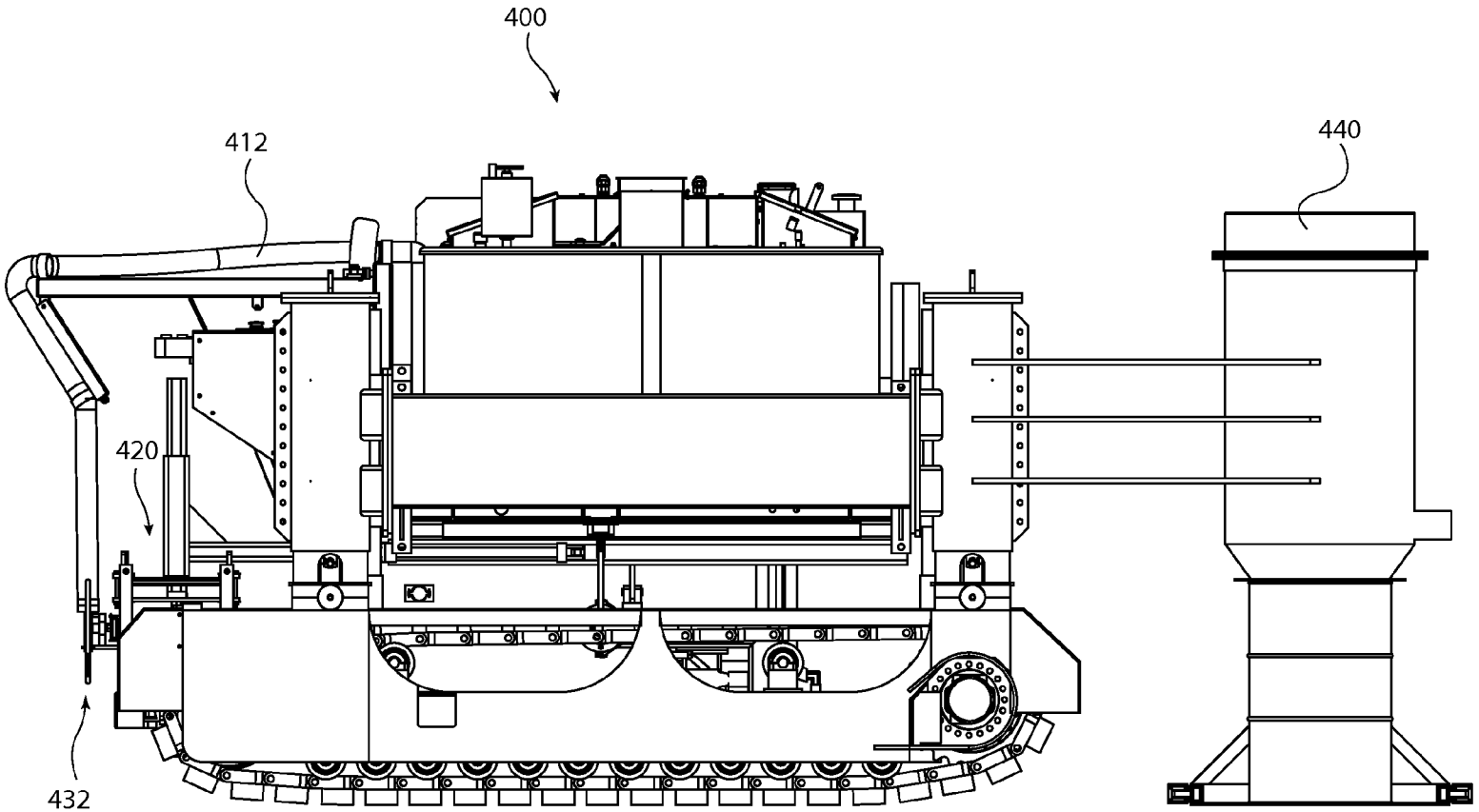
Figure 23:
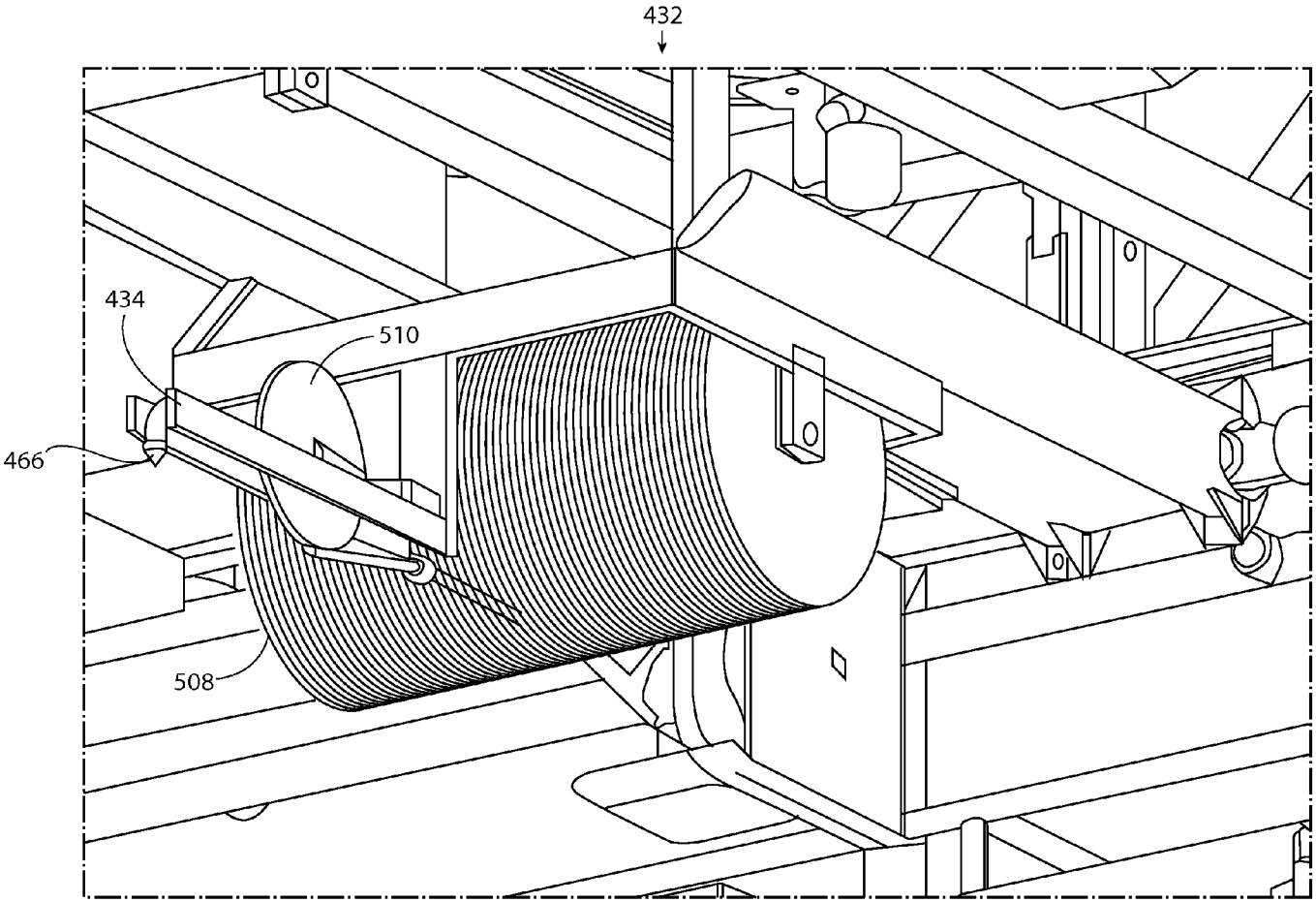
Figure 24:
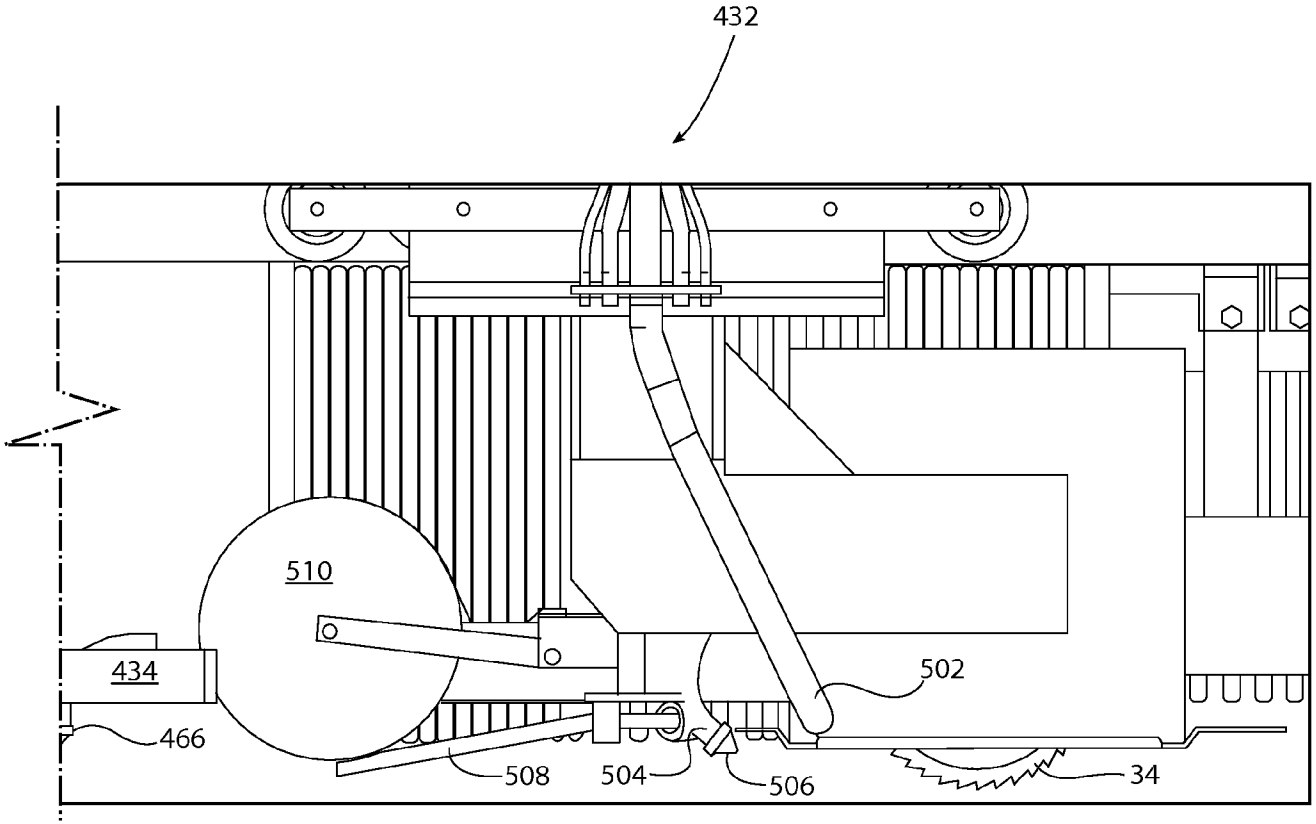

FIG. 20 is a perspective view of the apparatus 400 providing an overview of the saw assemblies 432 on the saw support assembly 420. FIG. 21 is an elevated view showing that the saw assemblies 432 may be mounted on the frame 410 at various points to operate longitudinally as the apparatus moves along a paving surface. Mounted on the saw support assembly 420 is at least one concrete saw assembly 432 disposed to operate traversely across the paving slab. Each concrete saw assembly 432 includes a rotating disk having a cutting edge. The rotating disk may be mounted on an axle which is in turn mounted on a saw support element which may be raised and lowered to a user selected depth. Adjusting the depth of the cut in the depicted embodiment is achieved by adjusting the hydraulic height adjuster. The support element and height adjuster are pivotally mounted on a saw frame.

The saw frame is mounted on transverse beam 428 in a manner to allow for transverse travel of a saw assembly 432 along the transverse beam 428. In the depicted embodiment, travel is mediated by a rack and pinion assembly. The saw must be powered and, in the depicted embodiment, power is via a hydraulic motor. Hydraulic motors for the saws and other hydraulic motors powering the tracks are powered by an engine. In one embodiment, two saw assemblies 432 may be mounted on the saw support assembly 420 to further speed cutting, and/or to more accurately cut a crowned road.

As above, the apparatus 400 may include a housing 460 configured to contain a compressor, vacuum, and sealant container. In one embodiment, a coolant reservoir may be additionally included. A tubing system 412 similar to the one shown in FIGS. 15-18 is provided and is configured to transport coolant, sealant, and pressurized gas proximate to each saw assembly 432. In one embodiment, the tubing system is additionally configured to transport debris using a vacuum. The tubing system may include a number of individual hoses or tubes to each saw assembly 432. For example, a coolant tube may be utilized to transport water from a reservoir to the saw disc, a vacuum tube may transport debris from the sawing area to a drum 440, and a sealant tube may apply sealant to the cut concrete. A fourth tube may apply pressurized air to the cut concrete to scatter cut debris before applying sealant. The tubing system is configured to travel with the saw assemblies along the associated saw assembly.

Each saw assembly 432, includes a sealant applicator 466 and an air pressure line nozzle 468. The sealant applicator 466 and the nozzle 468 may be disposed on a mounting bracket 434 of the saw assembly 432.

Similar to the operation of the above embodiment, a slab pour operation is set up with a roadbed, guidance system and paver provided. The saw 400 follows the paver along and over a poured slab by propelling itself on its tracks and supporting itself by ground contact only, without touching the slab. The apparatus 400 is advanced to a preconfigured position for an expansion joint slot and the first saw support assembly 420 is moved from its retracted position to an engaged position with only the saw blade contacting the surface of the slab.

Sawing can begin along two traversing axes, concurrently or sequentially, to a user selected depth. While traversing the poured slab in a single pass along the poured slab, the saw assemblies 432 sequentially and concurrently cut the slab using the blade 34, vacuum any debris in the cut joint, direct a stream of pressurized air to remove excess debris from the joint, fill in the joint with a filler material 508, and seal the joint. The debris is vacuumed using a suction line 502. Pressurized air is delivered to the cut joint using a pressurized line 504 and nozzle 506. Although, in one embodiment, instead of cleaning out the cut slot out by air pressure, water flushing or sand blasting, as selected by a user, may be used with the use of the appropriate compressor, nozzle, and reservoir. The nozzle may be controllable and configured to control the direction and characteristics of a flow and configured to transition among an ON and OFF operating state. The filler material 508 may be stored on a spool and direct to the cut joint via a wheel 510 sized and adapted to deposit the material a depth into the cut joint. The joint is sealed using a sealant applicator 466.

Supplementary procedures such as cooling the saw with water and flushing the slot may be done. When the slot is completely cut, vacuumed, cleaned, filled, and sealed the saw support assembly is retracted, the entire apparatus travels down the roadway as guided to the next preconfigured position for a slot to be cut and the process repeats. It is within the scope of the present invention that the saw may be used to cut concrete, and also other paving materials. Further, in some applications applying filler material may be excluded.

In the case of embodiments provided with longitudinally cutting saws, the procedure is similar; however, the longitudinal expansion joint slots are cut as the saw advances on its tracks. Since the saw generally moves while creating longitudinal slots and remains in a single position while transverse slots are cut, these two operations will generally be carried out sequentially rather than simultaneously.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A saw apparatus for sawing paving slabs, said paving slabs having a length and a width with said length being substantially greater than said width comprising:

a ground contacting propulsion member configured to straddle a paving slab;

a frame mounted on said ground contacting propulsion member such that no part of said frame nor said ground contact propulsion member need contact the slab during operation;

a first saw support assembly having at least one first support member and at least a first saw assembly mounted in connection with said first support member for linear motion of said saw assembly along said width of said paving slabs, said first saw support assembly having an engaged position and a disengaged position, said engaged position disposing a blade of said first saw assembly in cutting engagement with a top surface of said paving slabs;

a second saw assembly comprising a saw oriented to cut lengthwise of said paving slabs; and wherein the first and second saw assemblies each include a vacuum, a compressed air delivery device configured to selectively direct a stream of air at a cut slot, a filler delivery device, a sealant applicator.

2. The saw apparatus of claim 1, wherein the first support assembly is mechanically attached to a first hinged member configured to selectively position the first support assembly into the engaged position.

3. The saw apparatus of claim 2, wherein the first support assembly comprises a vertical adjustment mechanism configured to selectively adjust a height of the first saw support assembly.

4. The saw apparatus of claim 2, wherein the first hinged members are connected to the frame by a selectively actuatable telescoping member.

5. The saw apparatus of claim 1, further comprising:

a third saw assembly slidably connected to the first saw support assembly.

6. The saw apparatus of claim 1, wherein the first saw assembly is connected to the frame via one or more length adjustable members.

7. The saw apparatus of claim 1, wherein the first saw assembly is configured to cut a slot across the paving slabs, vacuum debris from the cut slot, clean debris from the cut slot, apply filler material within the cut slot, and apply sealant to the cut slot in a single pass across the paving slabs.

8. The saw apparatus of claim 1, wherein at least one of the saw assemblies includes a suction tube, a compressed air line, a wheel configured to press filler material within a cut slot, a spool, and a sealant applicator.

9. The saw apparatus of claim 1, wherein the second saw support assembly comprises a second support member and a second saw mounted in connection with said second support member for orientation of said second saw along said length of said paving slabs, said second saw support assembly having an engaged position and a removed position, said engaged position disposing a blade of said second saw in cutting engagement along said length of said top surface of said paving slabs as said ground contacting propulsion member advances said saw apparatus along said length of said paving slabs.

10. A saw apparatus for sawing paving slabs, said paving slabs having a length and a width with said length being substantially greater than said width comprising:

a ground contacting propulsion member configured to straddle a paving slab, wherein said group contact propulsion member further comprises at least one track;

a frame mounted on said ground contacting propulsion member such that no part of said frame nor said ground contact propulsion member need contact the slab during operation;

a plurality of vertical support elements supporting said frame on said ground contact propulsion member, wherein said vertical support elements further comprise vertical telescoping hydraulic cylinders;

a first saw support assembly having at least one first support member and at least a first saw assembly mounted in connection with said first support member for linear motion of a first saw along said width of said paving slabs;

a second saw support assembly comprising a second support member and a second saw assembly mounted in connection with said second support member for orientation of a second saw along said length of said paving slabs;

wherein the first and second saw assemblies each include a vacuum, a compressed air delivery device configured to selectively direct a stream of air at a cut slot, a filler delivery device, a sealant applicator configured to operate concurrently with respect to a cut slot and sequentially with respect to a point on the slot.

11. The saw apparatus of claim 10, wherein the first support assembly comprises a vertical adjustment mechanism configured to selectively adjust height of the first support assembly.

12. The saw apparatus of claim 10, wherein the first saw support assembly is mechanically attached to a first hinged member configured to selectively position the first support assembly into an engaged position said engaged position disposing a blade of said first saw in cutting engagement with a top surface of said paving slabs.

13. The saw apparatus of claim 12, wherein the first hinged member is connected to the frame by a selectively actuatable telescoping member.

14. The saw apparatus of claim 10, further comprising:

a third saw slidably connected to the first saw support assembly.

15. The saw apparatus of claim 10, wherein the first and second saw assemblies are connected to the frame via one or more length adjustable members.

16. A saw apparatus for sawing paving slabs, said paving slabs having a length and a width with said length being substantially greater than said width comprising:

a ground contacting propulsion member configured to straddle a paving slab, wherein said group contact propulsion member further comprises at least one track;

a frame mounted on said ground contacting propulsion member such that no part of said frame nor said ground contact propulsion member need contact the slab during operation;

a plurality of vertical support elements supporting said frame on said ground contact propulsion member;

a first saw support assembly having at least one first support member and at least a first saw mounted in connection with said first support member for linear motion of said saw along said width of said paving slabs;

a second saw support assembly connected in parallel to the first saw support assembly, wherein the second saw support assembly comprises a second support member and a second saw mounted in connection with said second support member for linear motion of said second saw along said width of said paving slabs;

a third saw support assembly comprising a third support member and a third saw mounted in connection with said third support member for orientation of said third saw along said length of said paving slabs, said third saw support assembly having an engaged position and a removed position; and wherein said first and second saws being mounted on said first and second saw assemblies, respectively.

17. The saw apparatus of claim 16, further comprising:

a transverse beam connected with said frame;

a first and a second pivoting support member, said first pivoting support member supporting said third saw and said second pivoting support member supporting a fifth saw, the third and the fifth saw each comprising a separate and independent power source; and wherein said first and second pivoting support members are selectively rotationally and slidably connected to said transverse beam, each of said first and second pivoting support members therefore being configured for selective rotational and sliding movement relative to said transverse beam.

18. The saw apparatus of claim 17, further comprising:

first and second connections of a first and a second end of said transverse beam with said frame and a third connection of a midpoint of said transverse beam with said frame, wherein said midpoint of said transverse beam is provided with at least one pivoting connection and wherein said third connection further comprises a vertical adjustment mechanism; and a sensor configured to determine a height of said paving slab at one or more points along its width and to generate a signal corresponding to said determined height and wherein said vertical adjustment mechanism is configured for receiving said signal and raising or lowering said midpoint of said transverse beam in response to said signal.

19. The saw apparatus of claim 1, wherein the vacuum, the compressed air delivery device, the filler delivery device, and the sealant applicator are disposed along a single axis on the first saw assembly.

20. The saw apparatus of claim 19, wherein the axis is parallel to a sawing orientation of the blade.

* * * * *